US009245537B2

(12) United States Patent
Suzuki

(10) Patent No.: US 9,245,537 B2
(45) Date of Patent: Jan. 26, 2016

(54) SPEECH ENHANCEMENT APPARATUS AND METHOD FOR EMPHASIZING CONSONANT PORTION TO IMPROVE ARTICULATION OF AUDIO SIGNAL

(71) Applicant: Panasonic Corporation, Osaka (JP)

(72) Inventor: Ryoji Suzuki, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 185 days.

(21) Appl. No.: 14/170,919

(22) Filed: Feb. 3, 2014

(65) Prior Publication Data

US 2014/0297273 A1 Oct. 2, 2014

(30) Foreign Application Priority Data

Mar. 27, 2013 (JP) ..... 2013-065866
Jan. 17, 2014 (JP) ..... 2014-006951

(51) Int. Cl.

*G10L 21/00* (2013.01)
*G10L 19/00* (2013.01)
*G10L 21/0316* (2013.01)
*G10L 25/93* (2013.01)

(52) U.S. Cl.

CPC ..... *G10L 21/0316* (2013.01); *G10L 25/93* (2013.01)

(58) Field of Classification Search

None
See application file for complete search history.

(56) References Cited

U.S. PATENT DOCUMENTS 5,530,768 A * 6/1996 Yoshizumi ..... G10L 21/0364 381/107
5,583,969 A * 12/1996 Yoshizumi ..... G10L 21/0364 704/225
7,457,741 B2 11/2008 Nakagawa et al.
7,542,577 B2 * 6/2009 Kiuchi ..... G10L 21/0364 379/406.01
8,190,432 B2 * 5/2012 Matsumoto ..... G10L 21/0364 704/254
2005/0195992 A1 * 9/2005 Kiuchi ..... G10L 21/0364 381/96
2005/0222845 A1 10/2005 Nakagawa et al.
2006/0206320 A1 * 9/2006 Li ..... G10L 21/0208 704/226
2012/0095755 A1 * 4/2012 Otani ..... G10L 21/0208 704/205

FOREIGN PATENT DOCUMENTS

JP 10-145897 5/1998
JP 2005-287600 10/2005
JP 2006-203683 8/2006
JP 2007-219188 8/2007
JP 4150795 9/2008
JP 4235128 3/2009
JP 2010-055002 3/2010

* cited by examiner

*Primary Examiner* — Marcus T Riley
(74) *Attorney, Agent, or Firm* — Wenderoth, Lind & Ponack, L.L.P.

(57) ABSTRACT

In a speech enhancement apparatus, a generator part generates a value representing likelihood of a consonant from an input audio signal, and a calculator part generates a consonant/vowel discriminating signal for discriminating a consonant portion and a vowel portion based on the generated value, detects a first signal level of the vowel portion and a second signal level of the consonant portion based on the audio signal and the consonant/vowel discriminating signal, and outputs a level-related signal. A determining part determines a gain coefficient that exceeds one when the second signal level is smaller than the first signal level based on the level-related signal so that the gain coefficient increases as the second signal level becomes smaller than the first signal level. A multiplier part multiplies the audio signal by the gain coefficient to output an audio signal having an emphasized consonant portion.

19 Claims, 15 Drawing Sheets

107

100J

SPEECH ENHANCEMENT APPARATUS AND METHOD FOR EMPHASIZING CONSONANT PORTION TO IMPROVE ARTICULATION OF AUDIO SIGNAL

CROSS-REFERENCE TO RELATED APPLICATIONS

This is an application, which claims priority to Japanese patent applications No. JP 2013-065866 filed on Mar. 27, 2013, and No. JP 2014-006951 filed on Jan. 17, 2014, the contents of which are incorporated herein by reference.

BACKGROUND OF THE DISCLOSURE

1. Field of the Disclosure

The present disclosure relates to a speech enhancement apparatus for emphasizing a consonant portion of an audio signal to improve articulation thereof, and a speech enhancement method therefor.

2. Description of the Related Art

Conventionally, a method for improving articulation by amplifying consonants in an input audio signal has been proposed (See, for example, Patent Document 1). However, the signal level of vowels with respect to the signal level of consonants relevant to the amount of masking of consonants by vowels largely changes depending on the utterer, the language and the phoneme even if the consonants are amplified in a manner similar to that of this method. Therefore, if consonants are amplified at a constant amplification factor, it is difficult to improve the articulation of speech when the signal level of the consonants is small. On the other hand, a method for securing the articulation by changing the amplification factor of consonants according to the time expansion ratio of vowels for approximation to an energy balance in the audio signal by natural utterance is proposed (See, for example, Patent Document 2).

Documents related to the present disclosures are as follows:

Patent Document 1: Japanese patent laid-open publication No. JP 2006-203683 A; and Patent Document 2: Japanese patent laid-open publication No. JP H10-145897 A.

However, the method of the Patent Document 2 has had such a problem that the masking of consonants by vowels is not sufficiently compensated for unless the time expansion ratio of the vowels is raised in the case of consonants whose signal level is small, and therefore, only unnatural speech could be obtained when the time durations of vowels are largely extended to sufficiently amplify the consonants. Further, the methods of the Patent Documents 1 and 2 have had such a problem that the articulation of speech can not be improved as a consequence of a failure in correctly amplifying the consonants since it is difficult to reliably discriminate the consonants and vowels from speech uttered in a real environment despite that the discrimination of consonants and vowels is performed.

SUMMARY OF THE DISCLOSURE

An object of the present disclosure is to solve the aforementioned problems and provide a speech enhancement apparatus and a speech enhancement method capable of improving the articulation of speech.

According to one aspect of the present disclosure, there is provided a speech enhancement apparatus including a generator part, a calculator part, a determining part, and a multiplier part. The generator part is configured to generate and output a value representing likelihood of a consonant from an input audio signal having a predetermined sampling frequency. The calculator part is configured to generate a consonant/vowel discriminating signal for discriminating a consonant portion and a vowel portion in the audio signal based on the value representing the likelihood of the consonant, detect a first signal level of the vowel portion and a second signal level of the consonant portion in the audio signal based on the audio signal and the consonant/vowel discriminating signal, and output a level-related signal representing a relation of the first signal level with respect to the second signal level. The determining part is configured to determine a gain coefficient that exceeds one when the second signal level is smaller than the first signal level based on the level-related signal so that the gain coefficient increases as the second signal level becomes smaller than the first signal level. The multiplier part is configured to multiply the audio signal by the gain coefficient and output an audio signal having an emphasized consonant portion thereof.

These comprehensive and specific aspects may be implemented by a system, a method, a computer program, and arbitrary combinations of systems, methods and computer programs.

According to the present disclosure, the speech enhancement apparatus and the speech enhancement method is provided which are able to improve the articulation of speech even when the signal level of consonants is small, and perform no processing when it is presumed that a music signal or the like other than a speech signal is inputted.

BRIEF DESCRIPTION OF THE DRAWINGS

These and other objects and features of the present disclosure will become clear from the following description taken in conjunction with the embodiments thereof with reference to the accompanying drawings throughout which like parts are designated by like reference numerals, and in which.

DETAILED DESCRIPTION OF THE EMBODIMENTS

Embodiments will be described in detail below with arbitrary reference to the drawings. It is noted that descriptions in detail more than necessary are sometimes omitted. For example, detailed descriptions of well-known matters and repetitive descriptions for substantially identical components are sometimes omitted. This intends to prevent the following description from becoming unnecessarily redundant and to facilitate understanding of those skilled in the art.

The inventor provides the accompanying drawings and the following description in order to make those skilled in the art sufficiently understand the present disclosure, and does not intend to limit the subjects claimed in the claims of the application for patent. That is, although the present disclosure is provided by the embodiments described below, it should be understood that the statements and the drawings configuring parts of the disclosure do not limit the present disclosure. Various alternative embodiments and operational techniques will become clear from the disclosure for those skilled in the art.

First Embodiment

Configuration of Speech Enhancement Apparatus 100

Figure 1:
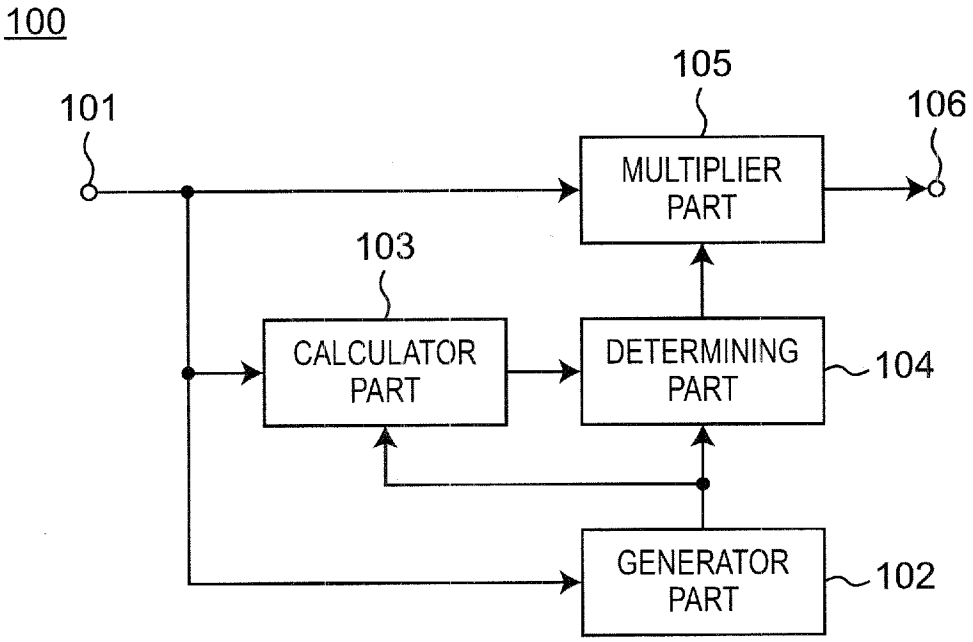
FIG. 1 is a block diagram showing a configuration of a speech enhancement apparatus 100 according to a first embodiment of the present disclosure.

FIG. 1 is a block diagram showing a configuration of a speech enhancement apparatus 100 according to the first embodiment of the present disclosure. The speech enhancement apparatus 100 of FIG. 1 is configured to include an input terminal 101, a generator part 102, a calculator part 103, a determining part 104, a multiplier part 105, and an output terminal 106.

Figure 2:
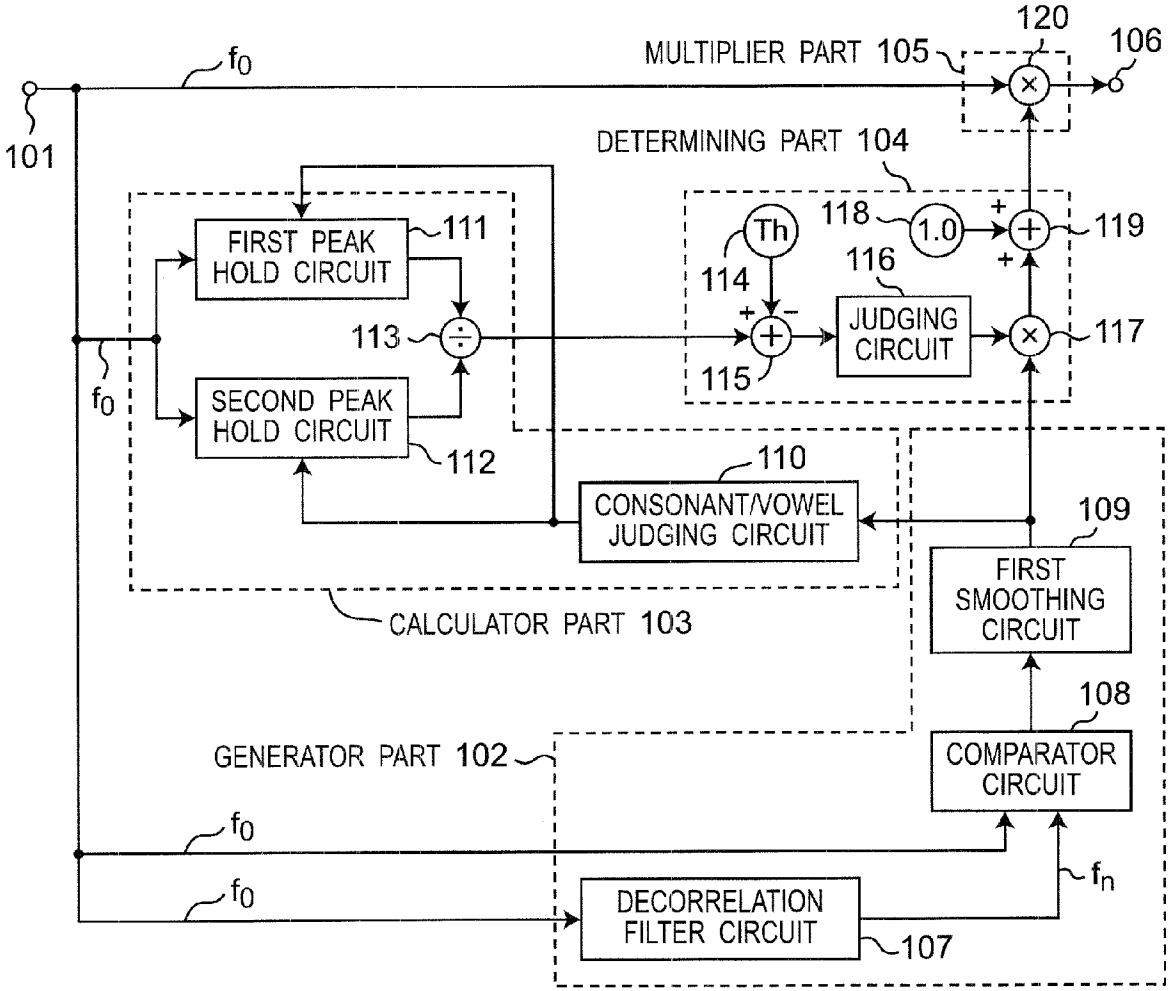
FIG. 2 is a block diagram showing a configuration of the speech enhancement apparatus 100 of FIG. 1.

FIG. 2 is a block diagram showing a configuration of the speech enhancement apparatus 100 of FIG. 1. Referring to FIG. 2, the generator part 102 for generating a value representing likelihood of the consonant is configured to include a decorrelation filter circuit 107, a comparator circuit 108, and a first smoothing circuit 109. Moreover, the calculator part 103 is configured to include a first peak hold circuit 111 that is a first integrator circuit of a fast-charge slow-discharge type, a second peak hold circuit 112 that is a second integrator circuit of a fast-charge slow-discharge type, a divider circuit 113, and a consonant/vowel judging circuit 110. In this case, the value representing the likelihood of the consonant is inputted, and a consonant/vowel discriminating signal for discriminating the consonant portion and the vowel portion in an audio signal is generated based on the value representing the likelihood of the consonant. Based on the audio signal and the consonant/vowel discriminating signal, a first signal level of the vowel portion and a second signal level of the consonant portion in the audio signal are detected, and a level-related signal representing a relation of the first signal level to the second signal level is outputted.

Referring to 2, the determining part 104 is configured to include a subtractor circuit 115, a judging circuit 116 that is a first judging circuit, a first multiplier circuit 117, an adder circuit 119, a threshold value generator 114 that generates a threshold value th, and a constant value generator 118 that generates a constant of "1.0". In this case, based on the aforementioned level-related signal representing the relation of the first signal level to the second signal level, a gain coefficient that exceeds one when the second signal level is smaller than the first signal level is determined so that the gain coefficient increases as the second signal level becomes smaller than the first signal level. It is noted that the gain coefficient becomes a value closing to one when the second signal level is larger than the first signal level. That is, when the signal level of consonants is smaller than the signal level of vowels, only the signal level of consonants is amplified so that it becomes on the same level as the signal level of vowels. Moreover, when the signal level of vowels is smaller than the signal level of consonants, the gain coefficient is set to be one since it is highly possible that the sound is a music whose signal level of the consonants needs not be amplified.

The multiplier part 105 is configured to include a second multiplier circuit 120. In this case, an audio signal is outputted which has an emphasized consonant portion thereof by multiplying the audio signal by the gain coefficient. Moreover, the input terminal 101 is a terminal for inspecting an audio signal $f_0$. The audio signal $f_0$ inputted from the input terminal 101 is outputted to the decorrelation filter circuit 107, the comparator circuit 108, the multiplier part 105, the first peak hold circuit 111, and the second peak hold circuit 112. The audio signal $f_0$ is a signal generated by sampling at a predetermined sampling frequency. The sampling frequency is, for example, 44.1 kHz in the case of a music CD, or 8 kHz in the case of a telephone line.

The decorrelation filter circuit 107 receives an input of the audio signal $f_0$ from the input terminal 101, removes a signal component having an autocorrelation from the audio signal $f_0$, extracts a signal having no periodicity, and outputs a signal having no periodicity as a filter output signal $f_n$ to the comparator circuit 108. In this case, the decorrelation filter circuit 107, of which the detail is described later, is a lattice filter circuit for removing the signal component having an autocorrelation from the audio signal $f_0$ inputted from the input terminal 101. The decorrelation filter circuit 107 extracts a signal (corresponding to a "forward prediction error signal "$f_n$" described later) having no periodicity other than the signal component having a periodicity. The signal component having a periodicity has an autocorrelation, and an example of this signal is like a signal of a vowel. Moreover, the signal having no periodicity has no autocorrelation, and an example of this signal is like a signal of a consonant.

The comparator 108 compares an amplitude of the audio signal $f_0$ inputted from the input terminal 101 with an amplitude of the filter output signal $f_n$ inputted from the decorrelation filter circuit 107, and outputs a comparison result to the first smoothing circuit 109. In this case, when the amplitude of the filter output signal $f_n$ outputted from the decorrelation filter circuit 107 is larger than the amplitude of the input audio signal $f_0$, the comparator circuit 108 judges that the input audio signal $f_0$ is a signal having no autocorrelation such as a consonant having no periodicity, and outputs a value of one. When the amplitude of the filter output signal $f_n$ of the decorrelation filter circuit 107 is smaller than the amplitude of the input audio signal $f_0$, the comparator circuit judges that the input audio signal is a signal having an autocorrelation such as a vowel having a periodicity, and outputs a value of zero.

The first smoothing circuit 109 integrates and smoothes the judgment results of zero and one for the audio signal $f_0$ outputted from the comparator circuit 108 or calculates the value representing the likelihood of the consonant by calculating the frequency of the value of one outputted from the comparator circuit 108, and outputs a value representing the likelihood of the consonant to the consonant/vowel judging circuit 110 and the multiplier circuit 117. In this case, when the frequency of outputs of the value of one from the comparator circuit 108 is high, the likelihood of the consonant is high, and a value closing to one is outputted as the value representing the likelihood of the consonant, and a value closing to zero is outputted as a value representing the likelihood of the consonant as the likelihood of the consonant is lower.

The consonant/vowel judging circuit 110 compares the value representing the likelihood of the consonant inputted from the first smoothing circuit 109 with a predetermined threshold value, generates a consonant/vowel discriminating signal representing whether the input audio signal $f_0$ is a consonant or not a consonant, and outputs a consonant/vowel discriminating signal to the first peak hold circuit 111 and the second peak hold circuit 112. In this case, the value of one is generated and outputted as the consonant/vowel discriminating signal upon judging that the input audio signal $f_0$ is a consonant when the value representing the likelihood of the consonant outputted from the first smoothing circuit 109 is larger than a predetermined threshold value. The value of zero is generated and outputted as the consonant/vowel discriminating signal upon judging that the input audio signal $f_0$ is other than a consonant when the value representing the likelihood of the consonant outputted from the first smoothing circuit 109 is smaller than a predetermined threshold value.

When receiving an input of the value of zero as the consonant/vowel discriminating signal from the consonant/vowel judging circuit 110, the first peak hold circuit 111 measures the signal level V of the audio signal $f_0$ inputted from the input terminal 101, and outputs a value of the signal level V to the divider circuit 113. In this case, the first peak hold circuit 111 measures the signal level V when the consonant/vowel judging circuit judges that the sound is other than a consonant.

When receiving an input of the value of one as the consonant/vowel discriminating signal from the consonant/vowel judging circuit 110, the second peak hold circuit 112 measures the signal level C of the audio signal $f_0$ inputted from the input terminal 101, and outputs a value of the signal level C to the divider circuit 113. In this case, the second peak hold circuit 112 measures the signal level C when the consonant/vowel judging circuit judges that the sound is a consonant.

The divider circuit 113 calculates a level ratio (V/C) by dividing the signal level V of other than consonants in the audio signal $f_0$ inputted from the first peak hold circuit 111 by the signal level C of consonants in the audio signal $f_0$ inputted from the second peak hold circuit 112, and outputs a value of the level ratio (V/C) to the subtractor circuit 115. In this case, the level-related signal representing the relation of the first signal level V of the audio signal $f_0$ to the second signal level C of the audio signal $f_0$ is generated as the level ratio (V/C).

The operation of each circuit of the determining part 104 of FIG. 2 is described next.

The subtractor circuit 115 subtracts the threshold value th from the value of the level ratio (V/C) inputted from the divider circuit 113, and outputs a subtraction result to the judging circuit 116. Moreover, the judging circuit 116 receives an input of the subtraction result from the subtractor circuit 115, compulsorily corrects the value of the subtraction result to the value of zero and outputs a value of zero to the first multiplier circuit 117 when the value of the subtraction result is a negative value based on the subtraction result. The judging circuit 116 outputs a value of the level ratio (V/C) as it is to the multiplier circuit 117 when the value of the subtraction result is other than a negative value.

The first multiplier circuit 117 multiplies the value representing the likelihood of the consonant inputted from the first smoothing circuit 109 by the value of zero inputted from the judging circuit 116 or the value of the level ratio (V/C), and outputs a value of the multiplication result to the adder circuit 119. Moreover, the adder circuit 119 adds a constant of "1.0" to the value of the multiplication result inputted from the first multiplier circuit 117, and outputs a value of the addition result as the gain coefficient to the second multiplier circuit 120.

As described above, the determining part 104 outputs a value closing to one to the second multiplier circuit 120 when the input audio signal $f_0$ is other than a consonant, and outputs a value larger than one to the second multiplier circuit 120 when the input audio signal $f_0$ is a consonant. That is, the gain coefficient comes to have a value closing to one when the signal level of the vowel portion in the audio signal $f_0$ is smaller than the signal level of the consonant portion in the audio signal $f_0$, and a value larger than one when the signal level of the consonant portion in the audio signal $f_0$ is smaller than the signal level of the vowel portion in the audio signal $f_0$.

The second multiplier circuit 120 multiplies the audio signal $f_0$ inputted from the input terminal 101 by the gain coefficient inputted from the adder circuit 119, and outputs a multiplication result to the output terminal 106. In this case, the signal level of the output signal of the second multiplier circuit 120 changes a little when the input audio signal $f_0$ is other than a consonant, and the signal level of the output signal of the second multiplier circuit 120 largely changes when the input audio signal $f_0$ is a consonant. That is, the signal level of the vowel portion in the audio signal $f_0$ scarcely changes, while the signal level of the consonant portion in the audio signal $f_0$ is largely amplified.

Configuration of Decorrelation Filter Circuit 107

Figure 3:
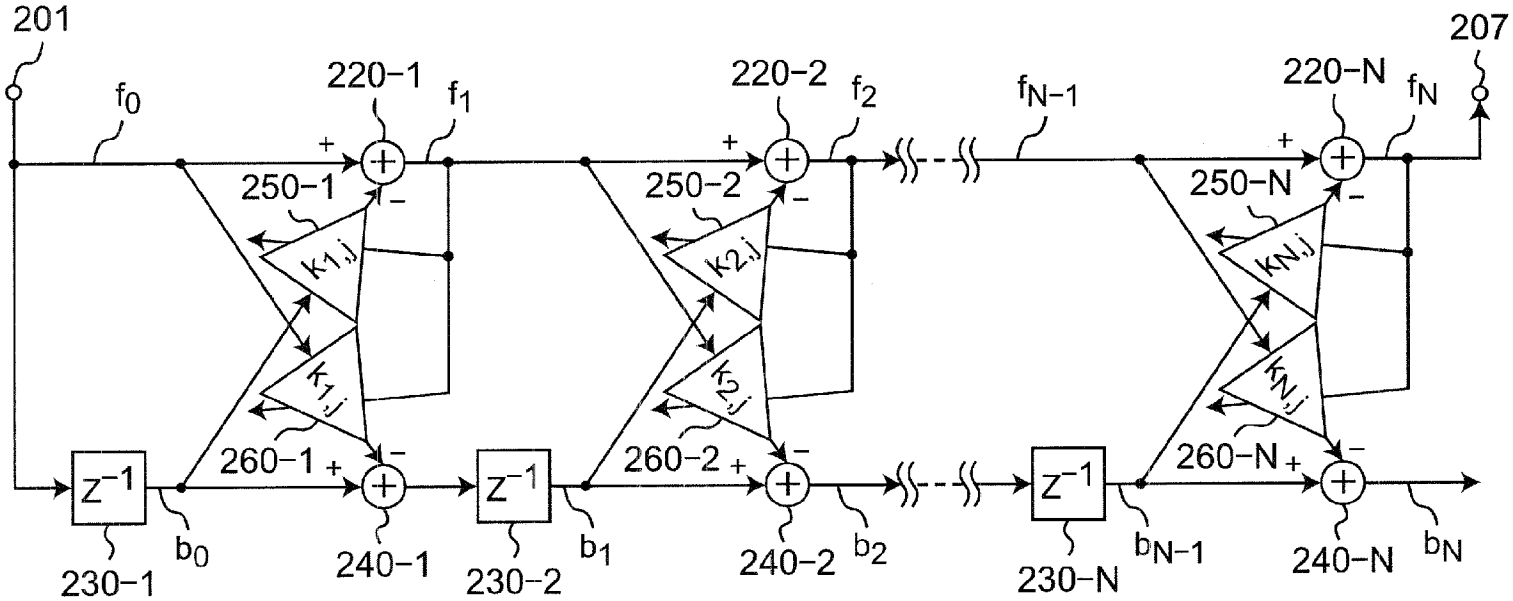
FIG. 3 is a block diagram showing a configuration of the decorrelation filter circuit 107 of FIG. 2.

FIG. 3 is a block diagram showing a configuration of the decorrelation filter circuit of FIG. 2. Referring to FIG. 3, the decorrelation filter circuit 107 is configured to include an input terminal 201, forward filter subtractor circuits 220-1 to 220-N, delay circuits 230-1 to 230-N, backward filter subtractor circuits 240-1 to 240-N, forward filter coefficient multiplier circuits 250-1 to 250-N, backward filter coefficient multiplier circuits 260-1 to 260-N, and an output terminal 207. In this case, N is a natural number, and indicates the number of stages. In the decorrelation filter circuit 107 of a lattice filter circuit and a sequential adaptive filter circuit as described above, a signal component having an autocorrelation in the audio signal can be converged at high speed forward and backward timewise by the forward filters and the backward filters.

The input terminal 201 outputs an audio signal $f_0$ inputted from the input terminal 101 to the forward filter subtractor circuit 220-1, the delay circuit 230-1, and the backward filter coefficient multiplier circuit 260-1. The forward filter subtractor circuits 220-1 to 220-N are connected mutually in cascade. In this case, the forward filter subtractor circuits 220-1 to 220-N perform calculations of the inputted signal based on the following Equation (1):

$$f_i = f_{i-1} - k_{i,j} \times b_{i-1} \quad (1),$$

where a variable "i" represents the number of stages of the forward filter subtractor circuits 220-1 to 220-N, and a variable "j" represents the time of the signals inputted to the forward filter subtractor circuits 220-1 to 220-N. It is noted that the variable "j" representing the time progresses in unit time, which is the reciprocal of the sampling frequency of the audio signal $f_0$. The unit time is 1/44100 (seconds) in the case of a music CD or 1/8000 (seconds) in the case of a telephone line. Moreover, in the Equation (1), $k_{i,j}$ is a filter coefficient at the time j of the i-th stage, and $b_{i-1}$ is a backward prediction error signal of the (i−1)-th stage.

First of all, the forward filter subtractor circuit 220-1 of the first stage generates a forward prediction error signal $f_1$ by calculating the audio signal $f_0$ with the variable "i" of the Equation (1) assumed to be one. The forward filter subtractor circuit 220-1 outputs a forward prediction error signal $f_1$ to the forward filter subtractor circuit 220-2, the forward filter coefficient multiplier circuit 250-1 and the backward filter coefficient multiplier circuit 260-1.

Next, the forward filter subtractor circuit 220-2 of the second stage generates a forward prediction error signal $f_2$ by calculating the forward prediction error signal $f_1$ with the variable "i" of the Equation (1) assumed to be two. The forward filter subtractor circuit 220-2 outputs a forward prediction error signal $f_2$ to the succeeding stage.

After the above processing is repetitively performed to the (N−1)-th stage, a forward prediction error signal $f_{N-1}$ is inputted to the forward filter subtractor circuit 220-N. The forward filter subtractor circuit 220-N of the N-th stage generates a forward prediction error signal $f_N$ by calculating the forward prediction error signal $f_{N-1}$ with the variable "i" of the Equation (1) assumed to be N. In the present embodiment, the amplitude of the forward prediction error signal $f_N$ becomes closer to zero as the autocorrelation of the audio signal $f_0$ is higher, and largely diverges as the autocorrelation of the audio signal $f_0$ is lower.

In this case, the autocorrelation of a vowel in the audio signal is high, and the autocorrelation of a consonant in the audio signal is low. Therefore, the amplitude of the forward prediction error signal $f_N$ becomes small when the audio signal $f_0$ is a vowel, and becomes large when the audio signal $f_0$ is a consonant. Such a forward prediction error signal $f_N$ is outputted from the forward filter subtractor circuit 220-N to the output terminal 207, the forward filter coefficient multiplier circuit 250-N and the backward filter coefficient multiplier circuit 260-N. The output terminal 207 of the present embodiment outputs a forward prediction error signal $f_N$ as a filter output signal $f_N$ to the comparator circuit 108.

The delay circuits 230-1 to 230-N and the backward filter subtractor circuits 240-1 to 240 are connected in cascade alternately to each other. The delay circuits 230-1 to 230-N subject the inputted signal to a delaying process for the unit time. First of all, the delay circuit 230-1 of the first stage generates a delayed signal $b_0$ by delaying the audio signal $f_0$ for the unit time. The delay circuit 230-2 of the second stage subjects a backward prediction error signal $b_1$ generated by the backward filter subtractor circuit 240-1 described later to a delaying process for the unit time. After such processing is repetitively performed, the delay circuit 230-N of the N-th stage subjects a backward prediction error signal $b_{N-2}$ generated by the backward filter subtractor circuit of the (N−1)-th stage to a delaying process for the unit time. The delay circuits 230-1 to 230-N output signals that have undergone the delaying process, to the backward filter subtractor circuits 240-1 to 240-N and the forward filter coefficient multiplier circuits 250-1 to 250-N, respectively.

Each of the backward filter subtractor circuits 240-1 to 240-N calculates the inputted signal based on the following Equation (2):

$$b_i = b_{i-1} - k_{i,j} \times f_{i-1} \quad (2),$$

where $k_{i,j}$ is a filter coefficient at the time j of the i-th stage, and $f_{i-1}$ is the forward prediction error signal of the (i−1)-th stage.

First of all, the backward filter subtractor circuit 240-1 of the first stage generates a backward prediction error signal $b_1$ by calculating a delayed signal $b_0$ with the variable "i" of the Equation (2) assumed to be one. The backward filter subtractor circuit 240-1 outputs a backward prediction error signal $b_1$ to the delay circuit 230-2. Next, the backward filter subtractor circuit 240-2 of the second stage generates a backward prediction error signal $b_2$ by calculating the backward prediction error signal $b_1$ that have undergone the delaying process for the unit time by the delay circuit 230-2 with the variable "i" of the Equation (2) assumed to be two.

After the above processing is repetitively performed to the (N−1)-th stage, a backward prediction error signal $b_{N-1}$ that have undergone the delaying process for the unit time by the delay circuit 230-N is inputted to the backward filter subtractor circuit 240-N of the N-th stage. The backward filter subtractor circuit 240-N of the N-th stage generates a backward prediction error signal $b_N$ by calculating the backward prediction error signal $b_{N-1}$ with the variable "i" of the Equation (2) assumed to be N.

The forward filter coefficient multiplier circuits 250-1 to 250-N multiply the respective signals inputted from the delay circuits 230-1 to 230-N by the filter coefficient $k_{i,j}$, and output resulting signals to the forward filter subtractor circuits 220-1 to 220-N, respectively. In this case, the forward filter coefficient multiplier circuits 250-1 to 250-N update the filter coefficient $k_{i,j}$ every unit time based on the following Equation (3). As described above, the unit time is 1/44100 (seconds) in the case of a music CD or 1/8000 (seconds) in the case of a telephone line.

$$\begin{aligned} k_{i,i+1} &= k_{i,j} + \Delta k_{i,j} \\ &= k_{i,j} + \alpha \times f_i / b_{i-1}, \end{aligned} \quad (3)$$

where $k_{i,j}$ is a filter coefficient at the time j of the i-th stage, and $\alpha$ is a constant (note that $0.0 \le \alpha \le 2.0$) to determine the convergence speed in the decorrelation filter circuit 107.

As described above, the forward filter coefficient multiplier circuits 250-1 to 250-N obtain a filter coefficient $k_{i,j+1}$ at the time j+1 of the i-th stage by adding a value, which is obtained by multiplying a quotient as a consequence of dividing a forward prediction error signal $f_i$ of the i-th stage by a backward prediction error signal $b_{i-1}$ of the (i−1)-th stage by the constant $\alpha$, to the filter coefficient $k_{i,j}$. Therefore, a difference between the filter coefficient $k_{i,j}$ and the filter coefficient $k_{i,j+1}$ (i.e., the amount of correction per unit time) becomes larger as the forward prediction error signal $f_i$ becomes larger. Thus, learning of the filter coefficient $k_{i,j}$ is executed every unit time in the forward filter coefficient multiplier circuits 250-1 to 250-N.

According to the speech enhancement apparatus 100 of the first embodiment, the level-related signal representing the relation between the second signal level of the consonant portion and the first signal level of the vowel portion in the input audio signal is generated, and the gain coefficient becomes larger as the second signal level becomes smaller than the first signal level based on the level-related signal, therefore making it possible to output an audio signal such that the consonant portion of the input audio signal is emphasized.

Moreover, according to the speech enhancement apparatus 100 of the first embodiment, the first smoothing circuit 109 outputs a value closing to one as the probability of the likelihood of the consonant is higher, and outputs a value closing to zero as the probability of the likelihood of the consonant is lower based on the filter output signal $f_n$ outputted from the decorrelation filter circuit 107. The adder circuit 119 adds the value of one to the value representing the likelihood of the consonant outputted from the first smoothing circuit 109, and the input audio signal $f_0$ is multiplied by the value of the addition result. Therefore, the level of the signal having no periodicity such as a consonant other than the signal having a periodicity such as a vowel can be raised even for a speech uttered in a real environment without clear discrimination between consonants and vowels. Therefore, by compensating for the hearing of a person whose audibility in the high sound region is deteriorated or compensating for the signal level of consonants that are easily masked by vowels, the articulation of the audio signal can be improved.

Further, according to the speech enhancement apparatus 100 of the first embodiment, the first multiplier circuit 117 multiplies the value representing the likelihood of the consonant outputted from the first smoothing circuit 109 by the value of the level ratio (V/C) of the signal level V of the portion other than consonants outputted from the judging circuit 116 to the signal level C of the consonant portion. Therefore, the amplitude of the signal level of consonants corresponding to the amount of masking of consonants by vowels can be compensated for, and the value of the output of the first multiplier circuit 117 becomes the value of zero or a value closing to zero when the signal level C of consonants is larger than the signal level of other parts than the consonants. Therefore, the signal level of consonants need not be amplified more than necessary, and the signal level becomes almost constant even when the input audio signal $f_0$ is a music that includes many signals having no periodicity such as a percussion instrument, and this prevents the musicality from being impaired.

Moreover, according to the speech enhancement apparatus 100 of the first embodiment, the filter coefficient of the decorrelation filter circuit 107 is updated every unit time (i.e., the reciprocal of the sampling frequency). Therefore, it is possible to extremely promptly estimate whether the audio signal $f_0$ inputted to the decorrelation filter circuit 107 is a signal having a periodicity such as a vowel or a signal having no periodicity such as a consonant, and therefore, consonants can be extracted with high accuracy from the audio signal $f_0$.

Second Embodiment

Next, a speech enhancement apparatus 100A according to the second embodiment is described with reference to the drawings. The points of difference from those of the first embodiment are mainly described below.

Figure 4:
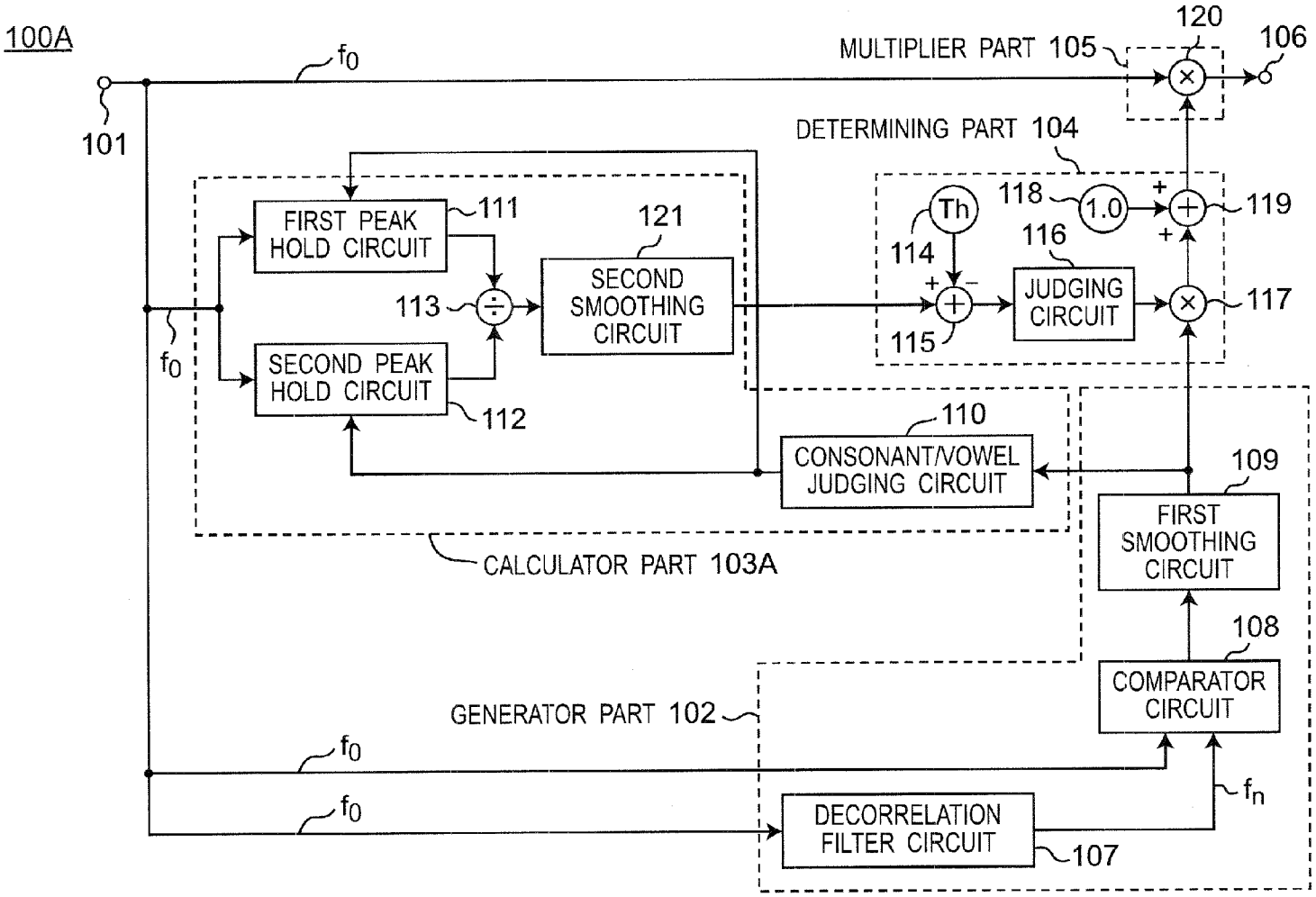
FIG. 4 is a block diagram showing a configuration of a speech enhancement apparatus 100A according to a second embodiment of the present disclosure.

FIG. 4 is a block diagram showing a configuration of the speech enhancement apparatus 100A of the second embodiment of the present disclosure. Referring to FIG. 4, a calculator part 103A is characterized by further including a second smoothing circuit 121 at the succeeding stage of the divider circuit 113 by comparison to the calculator part 103 of FIG. 2.

Referring to FIG. 4, the second smoothing circuit 121 receives an input of the value of the level ratio (V/C) of the signal level V of other than consonants outputted from the divider circuit 113 to the signal level C of consonants, performs a smoothing process of the value of the level ratio (V/C), and outputs a smoothed value to the subtractor circuit 115. That is, a level-related signal representing the relation of the signal level V to the signal level C is subjected to the smoothing process and outputted to the determining part 104.

The speech enhancement apparatus 100A of the present embodiment has action and advantageous effects similar to those of the first embodiment. Moreover, according to the speech enhancement apparatus 100A of the present embodiment, the second smoothing circuit 121 is further provided by comparison to the speech enhancement apparatus 100 of the first embodiment, and therefore, the level ratio (V/C) outputted from the divider circuit 113 is smoothed. Therefore, even if the signal level V of other than consonants and the signal level C of consonants largely change in a short time, the output of the second smoothing circuit 121 comes to have a gradual change. Therefore, the value of the level ratio (V/C) is not largely changed by a change in the signal level as a consequence of changes in the kind of consonants and the kind of vowels in the audio signal $f_0$ inputted from the input terminal 101 by comparison to the speech enhancement apparatus 100 of the first embodiment. Therefore, the amplification of the consonant portion of the audio signal $f_0$ inputted in the second multiplier circuit 120 becomes smooth for easy hearing.

Third Embodiment

Although the articulation of speech is improved by increasing the amplitude of the signal level of consonants in the input audio signal s $f_0$ according to the aforementioned embodiments, the present disclosure is not limited to this. For example, the articulation of speech can also be improved by reducing the amplitude of noises in the input audio signal s $f_0$. The third embodiment is described in concrete below.

Figure 5A:
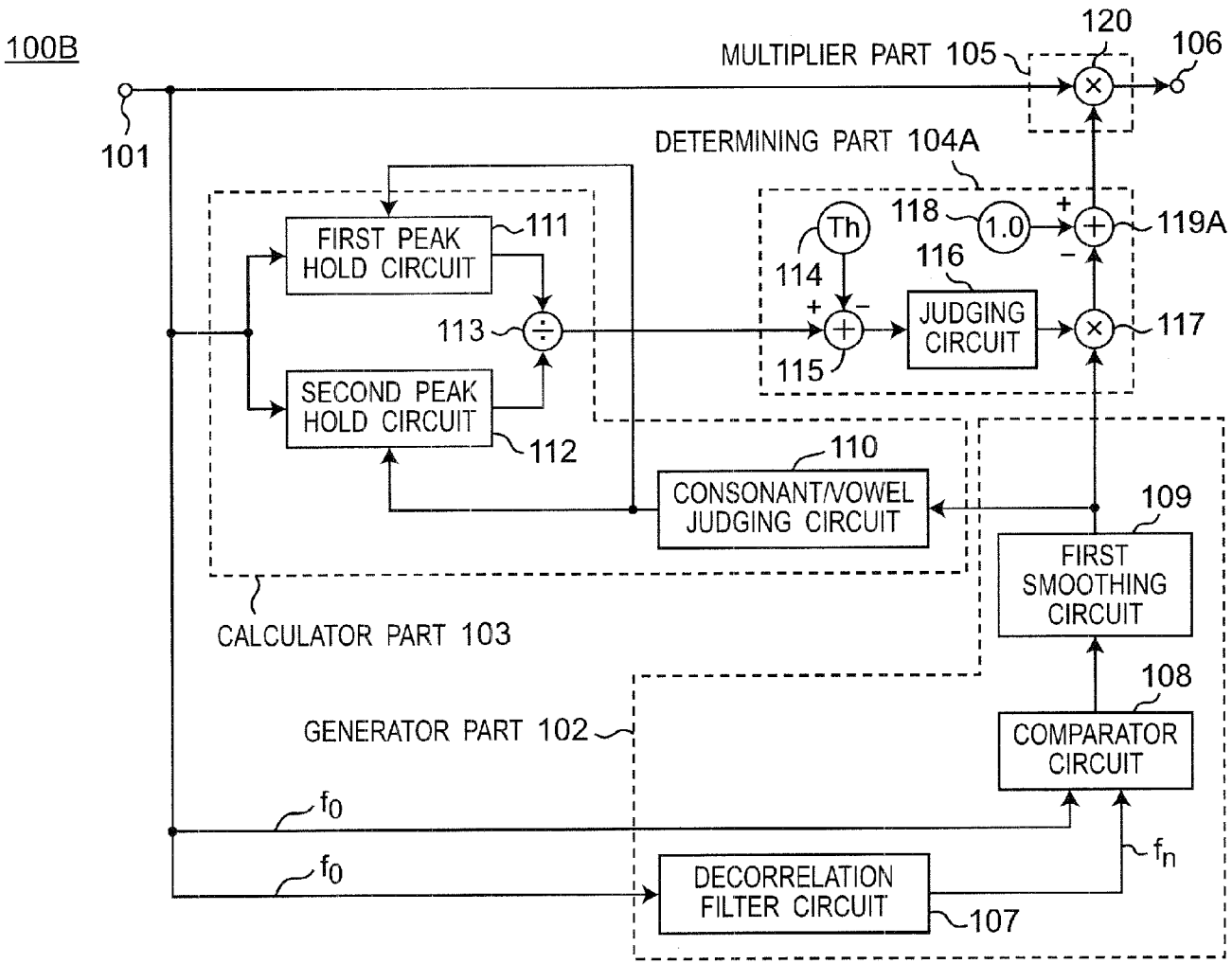
FIG. 5A is a block diagram showing a configuration of a speech enhancement apparatus 100B according to a third embodiment of the present disclosure.

FIG. 5A is a block diagram showing a configuration of a speech enhancement apparatus 100B according to the third embodiment of the present disclosure. Referring to FIG. 5A, the speech enhancement apparatus 100B is characterized by configuring to include a determining part 104A in place of the determining part 104 by comparison to the speech enhancement apparatus 100 of FIG. 2. Moreover, the determining part 104A is characterized by configuring to include a subtractor circuit 119A in place of the adder circuit 119 by comparison to the determining part 104 of FIG. 2.

Referring to FIG. 5A, the subtractor circuit 119A subtracts the value of a multiplication result inputted from the first multiplier circuit 117 from the constant of "1.0", and outputs a subtraction result as the gain coefficient to the second multiplier circuit 120. In this case, the value of zero is outputted when the subtraction result is a negative value or the value inputted from the first multiplier circuit 117 is outputted as it is when the result is a positive value.

According to the speech enhancement apparatus 100B of the present embodiment, the amplitude of the signal levels of signals having no periodicity such as noises other than the signal having a periodicity such as vowels can be reduced in the output signal of the second multiplier circuit 120. Therefore, since the noises can be removed from the audio signal $f_0$, the articulation of speech can be improved.

The speech enhancement apparatus 100B of the present embodiment has action and advantageous effects similar to those of the first embodiment. Moreover, according to the speech enhancement apparatus 100B of the present embodiment, the articulation of speech can be improved by reducing the amplitude of a percussion instrument sound of the audio signals $f_0$.

Further, according to the speech enhancement apparatus 100B of the present embodiment, only the amplitude of the signal level of a signal having no periodicity such as a percussion instrument sound other than a signal having a periodicity such as a stringed instrument sound can be suppressed in the output signal of the second multiplier circuit 120 when the percussion instrument sound and the stringed instrument sound are mixed in the audio signal $f_0$.

Figure 5B:
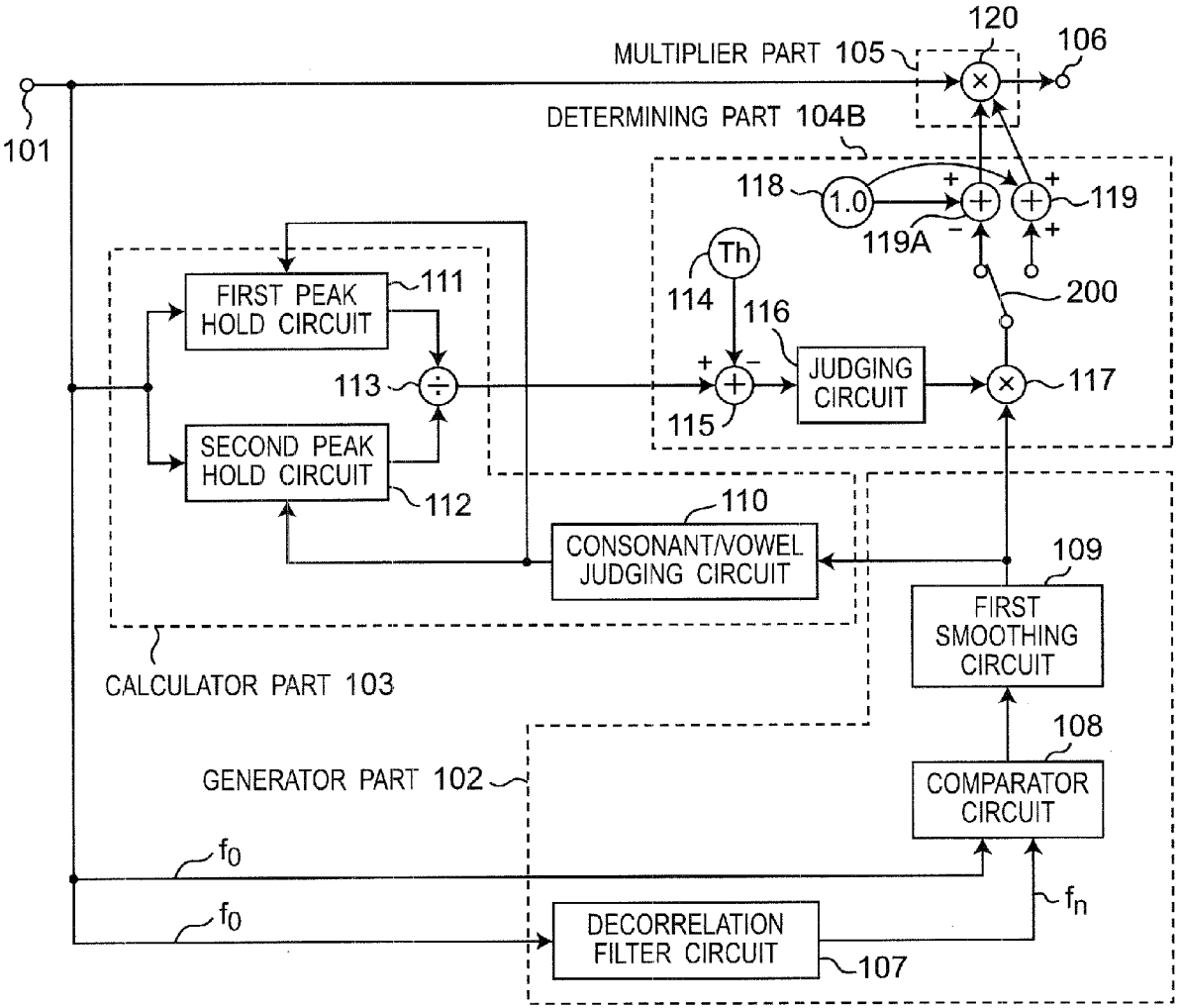
FIG. 5B is a block diagram showing a configuration of a speech enhancement apparatus 100C according to a modified embodiment of the third embodiment of the present disclosure.

FIG. 5B is a block diagram showing a configuration of a speech enhancement apparatus 100C according to a modified embodiment of the third embodiment of the present disclosure. Referring to FIG. 5B, the speech enhancement apparatus 100C is characterized by configuring to include a determining part 104B in place of the determining part 104 by comparison to the speech enhancement apparatus 100 of FIG. 2. Moreover, the determining part 104B is characterized by further including a subtractor circuit 119A by comparison to the determining part 104 of FIG. 2 and further including a switchover part 200 that is a first switchover part configured to perform selective switchover by, for example, the user as to whether the value of the multiplication result from the first multiplier circuit 117 is outputted to the second multiplier circuit 120 via the adder circuit 119 of the first embodiment or to the second multiplier circuit 120 via the subtractor circuit 119A of the third embodiment. In this case, it is possible to emphasize only the percussion instrument sound having no periodicity by performing switchover to the adder circuit 119 by the switchover part 200. That is, switchover to the adder circuit 119 is performed by using the switchover part 200 when, for example, the user desires to emphasize the consonant portion or switchover to the subtractor circuit 119A that is the second subtractor circuit is performed by using the switchover part 200 when the vowel portion is desired to be emphasized.

Fourth Embodiment

Figure 6:
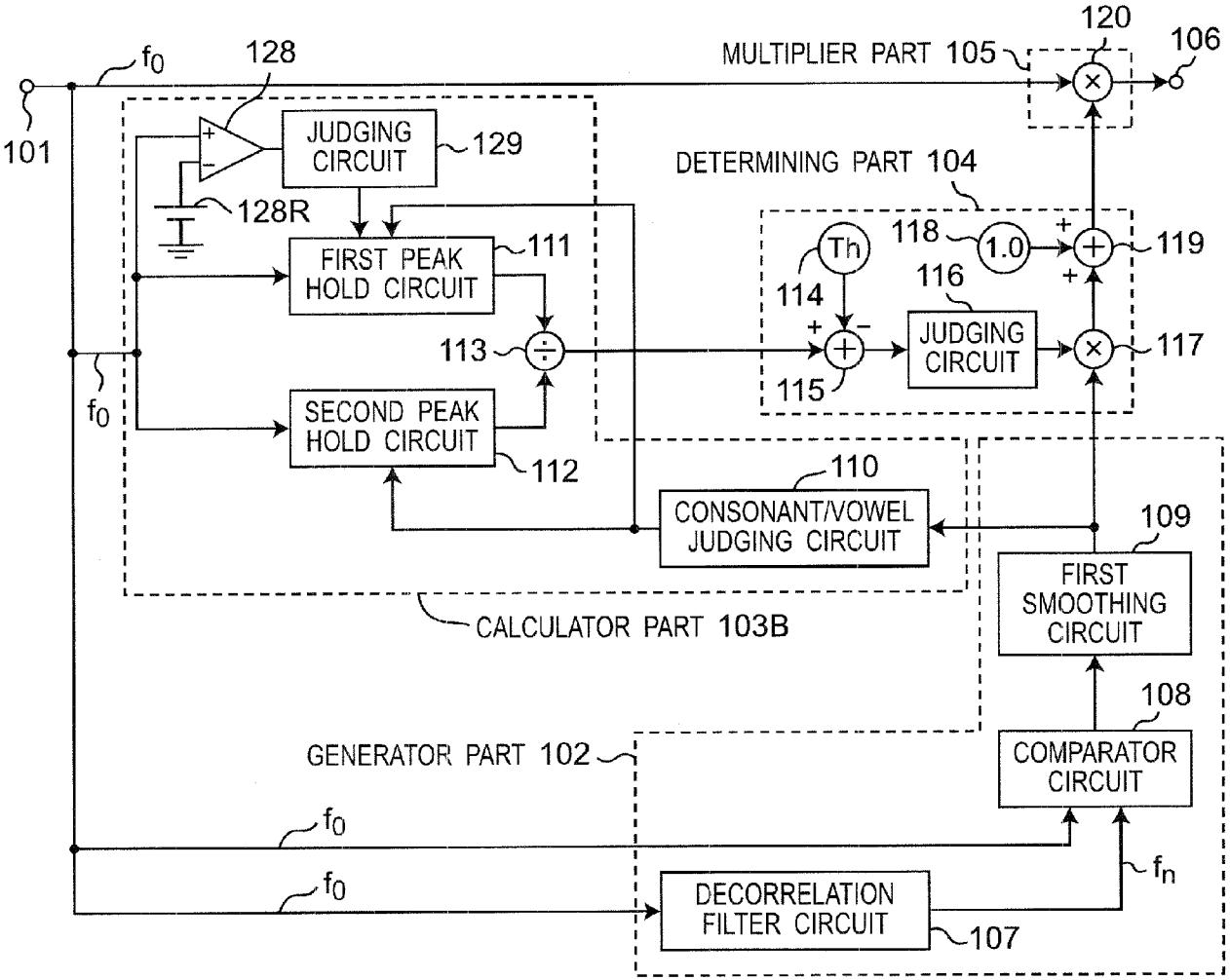
FIG. 6 is a block diagram showing a configuration of a speech enhancement apparatus 100D according to a fourth embodiment of the present disclosure.

FIG. 6 is a block diagram showing a configuration of a speech enhancement apparatus 100D according to the fourth embodiment of the present disclosure. Referring to FIG. 6, the speech enhancement apparatus 100D is characterized by configuring to include a calculator part 103B in place of the calculator part 103 by comparison to the speech enhancement apparatus 100 of FIG. 2. Moreover, the calculator part 103B of FIG. 6 is characterized by further including a judging circuit 129 that is a first judging part configured to stop measuring the signal level V in the first peak hold circuit 111 by comparison to the calculator part 103 of FIG. 2, and further including a comparator 128 having a threshold level 128R at the preceding stage of the judging circuit 129.

Referring to FIG. 6, the comparator 128 compares the voltage level of the input audio signal $f_0$ with the predetermined threshold level 128R, and outputs a comparison result to the judging circuit 129. Moreover, the judging circuit 129 generates a signal for stopping the first peak hold circuit 111 based on the comparison result from the comparator 128, and outputs the same signal to the first peak hold circuit 111. In this case, the judging circuit 129 stops the first peak hold circuit 111 when the voltage level of the audio signal $f_0$ is not greater than the threshold level 128R.

The speech enhancement apparatus 100D of the present embodiment has action and advantageous effects similar to those of the first embodiment. Moreover, according to the speech enhancement apparatus 100D of the present embodiment, by comparison to the speech enhancement apparatus 100 of the first embodiment, measurement in the first peak hold circuit 111 is stopped when the value of zero is outputted as the consonant/vowel discriminating signal from the consonant/vowel judging circuit 110 and further when the voltage level of the input audio signal $f_0$ is not greater than the threshold level 128R. Therefore, it is possible to correctly obtain the signal level of vowels while further reducing the amount of calculation as a consequence that the measurement of the signal level in the silent interval is avoided. That is, it is determined that there is silence when the voltage level of the audio signal $f_0$ is not greater than the predetermined threshold value 128R, and the integration operation is stopped.

Although the judging circuit 129 generates the signal for stopping the first peak hold circuit 111 by using the voltage level of the audio signal $f_0$ in the present embodiment, the present disclosure is not limited to this, and similar advantageous effects can be obtained even when the current level of the audio signal $f_0$ is used.

Fifth Embodiment

Figure 7:
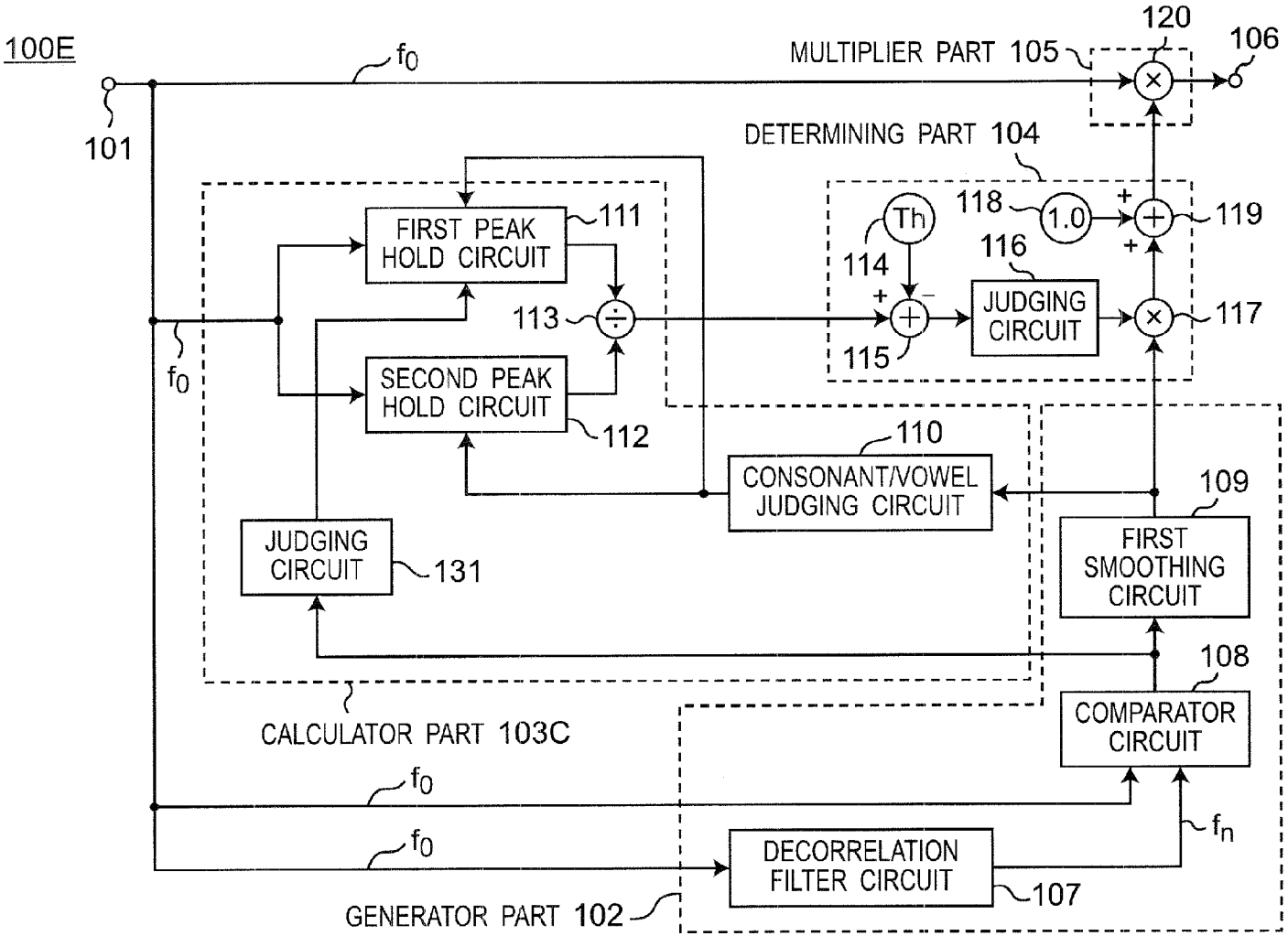
FIG. 7 is a block diagram showing a configuration of a speech enhancement apparatus 100E according to a fifth embodiment of the present disclosure.

FIG. 7 is a block diagram showing a configuration of a speech enhancement apparatus 100E according to the fifth embodiment of the present disclosure. Referring to FIG. 7, the speech enhancement apparatus 100E is characterized by configuring to include a calculator part 103C in place of the calculator part 103 by comparison to the speech enhancement apparatus 100 of FIG. 2. Moreover, the calculator part 103C is characterized by further including a judging circuit 131 that is a second judging part configured to stop the measurement of the signal level V in the first peak hold circuit 111 by comparison to the calculator part 103 of FIG. 2.

Referring to FIG. 7, the judging circuit 131 generates a signal for stopping the first peak hold circuit 111 based on the comparison result from the comparator circuit 108, and outputs the same signal to the first peak hold circuit 111. In this case, the judging circuit 131 measures the signal level V of the audio signal $f_0$ when the amplitude of the voltage level of the input audio signal $f_0$ is, for example, about ten times larger than the amplitude of the voltage level of the filter output signal $f_n$ of the decorrelation filter circuit 107 and it is presumed that the decorrelation filter circuit 107 converges, and stops the measurement of the signal level V of the audio signal $f_0$ in the other case.

The speech enhancement apparatus 100E of the present embodiment has action and advantageous effects similar to those of the first embodiment. Moreover, according to the speech enhancement apparatus 100E of the present embodiment, by comparison to the speech enhancement apparatus 100 of the first embodiment, measurement of the signal level V can be performed when the value of zero is outputted as the consonant/vowel discriminating signal from the consonant/vowel judging circuit 110 and further when the amplitude of the input audio signal $f_0$ is, for example, about ten times larger than the amplitude of the filter output signal $f_n$ of the decorrelation filter circuit 107 and it is presumed that the decorrelation filter circuit 107 converges, and the measurement of the signal level V of can be stopped in the other case. Therefore, measurement of the signal level in an interval where the decorrelation filter circuit 107 does not converge and there is a high possibility of not a vowel but silent is avoided, and the signal level of vowels can be correctly obtained while reducing the amount of calculation.

Although the signal for stopping the first peak hold circuit 111 by using the voltage level of the audio signal $f_0$ is generated in the present embodiment, the present disclosure is not limited to this, and similar advantageous effects can be obtained even when the current level of the audio signal $f_0$ is used.

Sixth Embodiment

Figure 8A:
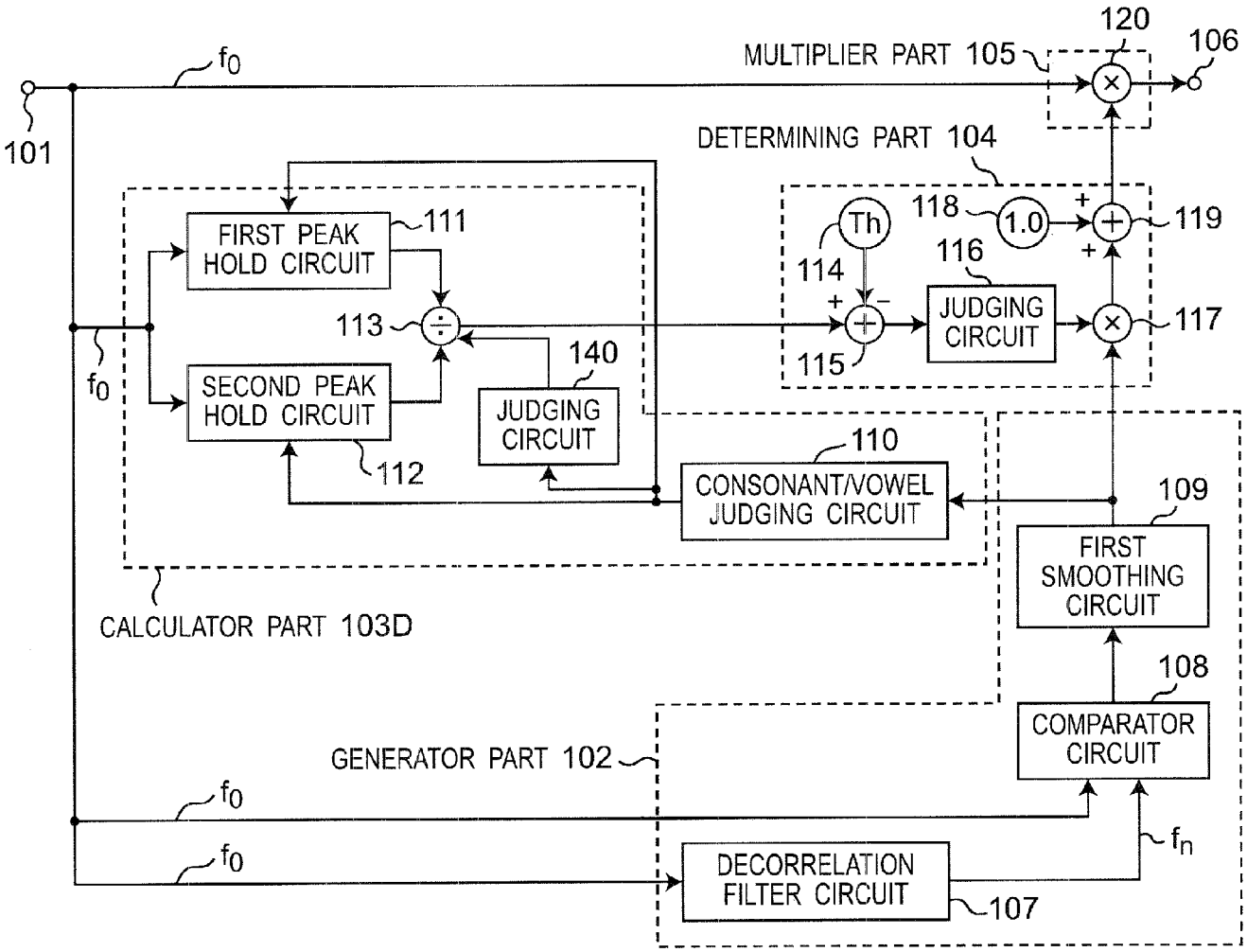
FIG. 8A is a block diagram showing a configuration of a speech enhancement apparatus 100F according to a sixth embodiment of the present disclosure.

FIG. 8A is a block diagram showing a configuration of a speech enhancement apparatus 100F according to the sixth embodiment of the present disclosure. Referring to FIG. 8A, the speech enhancement apparatus 100F is characterized by configuring to include a calculator part 103D in place of the calculator part 103 by comparison to the speech enhancement apparatus 100 of FIG. 2. Moreover, the calculator part 103D is characterized by further including a judging circuit 140 that is a third judging part configured to allow the divider circuit 113 to operate by comparison to the calculator part 103 of FIG. 2.

Referring to FIG. 8A, the judging circuit 140 generates a signal for operating the divider circuit 113 based on the consonant/vowel discriminating signal inputted from the consonant/vowel judging circuit 110, and outputs the same signal to the divider circuit 113. In this case, the divider circuit 113 can limit the frequency of outputting the value of the level ratio (V/C) by dividing the value of the signal level V of other than consonants outputted from the first peak hold circuit 111 by the value of the signal level C of consonants outputted from the second peak hold circuit 112 to the time of a change from a consonant to a vowel, conversely to the time of a change from a vowel to a consonant or the time after the first peak hold circuit 111 or the second peak hold circuit 112 detects a peak. For example, in the sixth embodiment, the judging circuit 140 is a second judging circuit that allows the divider circuit 113 to operate only for a definite period after a change from a consonant to a vowel or a change from a vowel to a consonant.

The speech enhancement apparatus 100F of the present embodiment has action and advantageous effects similar to those of the first embodiment. Moreover, according to the speech enhancement apparatus 100F of the present embodiment, by comparison to the speech enhancement apparatus 100 of the first embodiment, the divider circuit 113 can reduce the frequency of outputting the value of the level ratio (V/C) by dividing the signal level V of other than consonants outputted from the first peak hold circuit 111 by the signal level C of other than consonants outputted from the second peak hold circuit 112, and therefore, the amount of calculation can be further reduced.

Seventh Embodiment

Figure 8B:
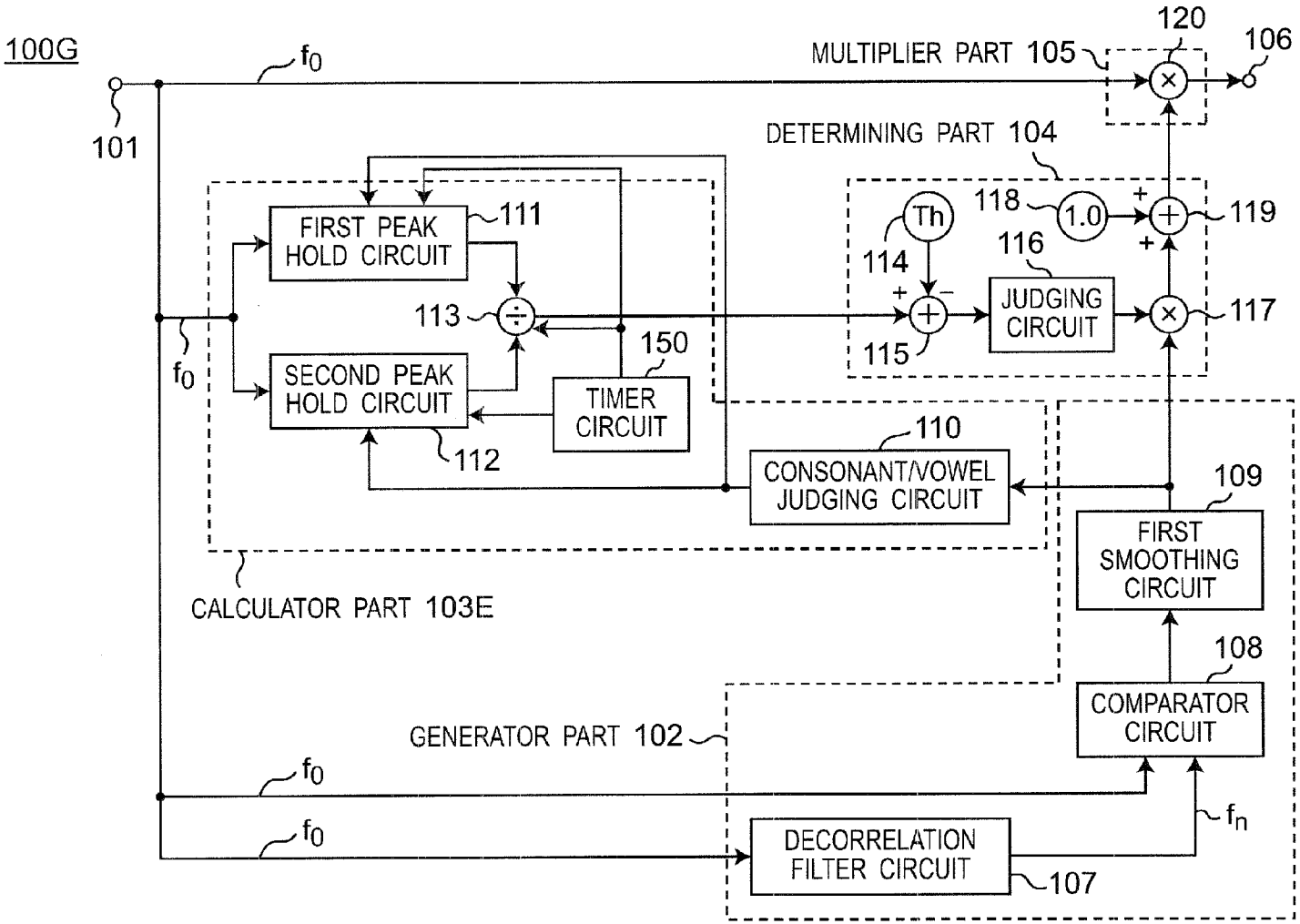
FIG. 8B is a block diagram showing a configuration of a speech enhancement apparatus 100G according to a seventh embodiment of the present disclosure.

FIG. 8B is a block diagram showing a configuration of a speech enhancement apparatus 100G according to the seventh embodiment of the present disclosure. Referring to FIG. 8B, the speech enhancement apparatus 100G is characterized by configuring to include a calculator part 103E in place of the calculator part 103 by comparison to the speech enhancement apparatus 100 of FIG. 2. Moreover, the calculator part 103E is characterized by further including a timer circuit 150 to allow the first peak hold circuit 111, the second peak hold circuit 112 and the divider circuit 113 to operate by comparison to the calculator part 103 of FIG. 2.

Referring to FIG. 8B, the timer circuit 150 measures predetermined first time of, for example, several seconds, and periodically repetitively allows the first peak hold circuit 111 and the second peak hold circuit 112 to operate so that the first peak hold circuit 111 and the second peak hold circuit 112 measure the maximum values of the signal level V and the signal level C of the audio signal $f_0$ within the predetermined first time. Moreover, the timer circuit 150 periodically repetitively allows the divider circuit 113 to operate after a lapse of every predetermined first time. For example, in the seventh embodiment, the timer circuit 150 measures definite time of, for example, three seconds, each of the first peak hold circuit 111 and the second peak hold circuit 112 detects the maximum value in three seconds, and the divider circuit 113 operates after a lapse of every three seconds. According to this configuration, the frequency of operation of the divider circuit 113 can be limited to the time when the timer circuit 150 finishes measuring the first time.

The speech enhancement apparatus 100G of the present embodiment has action and advantageous effects similar to those of the first embodiment. Moreover, according to the speech enhancement apparatus 100G of the present embodiment, by comparison to the speech enhancement apparatus 100 of the first embodiment, the frequency that the divider circuit 113 outputs a value of the level ratio (V/C) by dividing the signal level V of other than consonants outputted from the first peak hold circuit 111 by the signal level C of consonants outputted from the second peak hold circuit 112 can be reduced, and therefore, the amount of calculation can be further reduced.

Eighth Embodiment

Figure 8C:
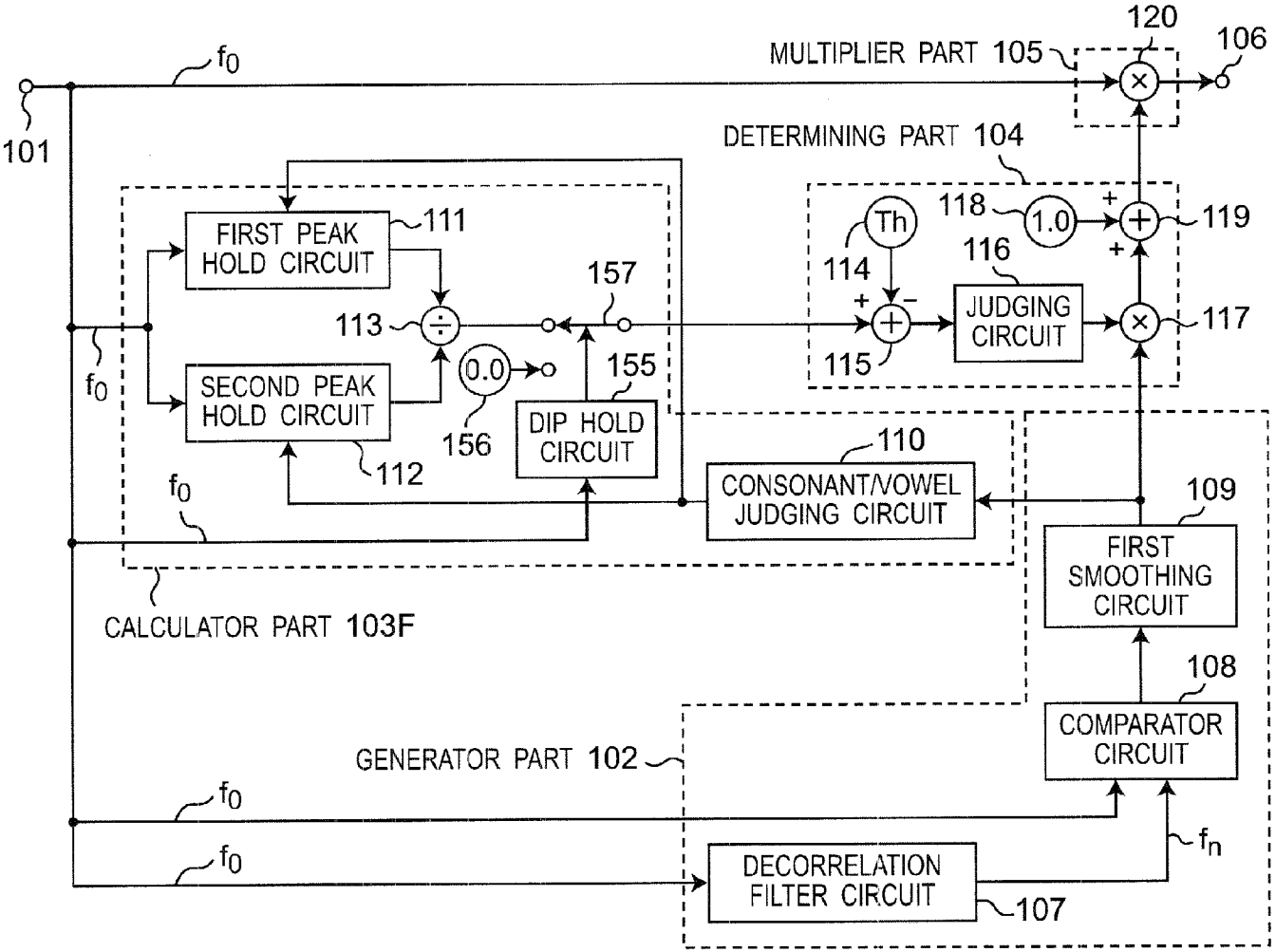
FIG. 8C is a block diagram showing a configuration of a speech enhancement apparatus 100H according to an eighth embodiment of the present disclosure.

FIG. 8C is a block diagram showing a configuration of a speech enhancement apparatus 100H according to the eighth embodiment of the present disclosure. Referring to FIG. 8C, the speech enhancement apparatus 100H is characterized by configuring to include a calculator part 103F in place of the calculator part 103 by comparison to the speech enhancement apparatus 100 of FIG. 2. Moreover, by comparison to the calculator part 103 of FIG. 2, the calculator part 103F is characterized by further including a dip-hold circuit 155 that is a third integrator circuit of a low-speed charge high-speed discharge type configured to allow a switchover part 157 to operate described later, a constant generator 156 configured to generate a constant of "0.0", and a switchover part 157 that is a second switchover part configured to perform selective switchover as to whether the value of the constant of "0.0" from the constant generator 156 is outputted to the subtractor circuit 115 or the value of the level ratio (V/C) from the divider circuit 113 is outputted to the subtractor circuit 115.

Referring to FIG. 8C, the dip-hold circuit 155 measures the minimum signal level of the audio signal $f_0$ inputted from the input terminal 101, and controls the switchover part 157 so that the value of the constant of "0.0" from the constant generator 156 is outputted to the subtractor circuit 115 when the minimum signal level is equal to or larger than a predetermined second threshold value or the value of the level ratio (V/C) from the divider circuit 113 is outputted to the subtractor circuit 115 when the minimum signal level is smaller than the predetermined second threshold value. In this case, when it is difficult to amplify consonants because the signal levels of background noises and background music are high, the predetermined second threshold value is set to a value that the minimum signal level measured by the dip-hold circuit 155 exceeds. That is, switchover to the constant generator 156 is effected by using the switchover part 157 when the signal levels of the background noises and background music are comparatively high or switchover to the divider circuit 113 is effected by using the switchover part 157 when the signal levels of the background noises and background music are comparatively low.

The speech enhancement apparatus 100H of the present embodiment has action and advantageous effects similar to those of the first embodiment. Moreover, according to the speech enhancement apparatus 100H of the present embodiment, by comparison to the speech enhancement apparatus 100 of the first embodiment, the constant of "0.0" from the constant generator 156 is outputted to the subtractor circuit 115 when the signal levels of the background noises and the background music are high, and therefore, the audio signal $f_0$ inputted from the input terminal 101 is not amplified at all. Therefore, consonants are prevented from being amplified when the signal levels of the background noises and the background music are high, and this therefore makes it possible to improve the quality of the output signal outputted from the output terminal 106.

Ninth Embodiment

The first smoothing circuit 109 of the first embodiment integrates and smoothes a judgment result of the comparator circuit 108 or the value representing the likelihood of the consonant is calculated by calculating the frequency of outputting the value of one in the judgment result of the comparator circuit 108. However, the value representing the likelihood of the consonant may be calculated by executing a predetermined calculating process for the output value from the first smoothing circuit 109 in order to further emphasize the consonants.

Figure 8D:
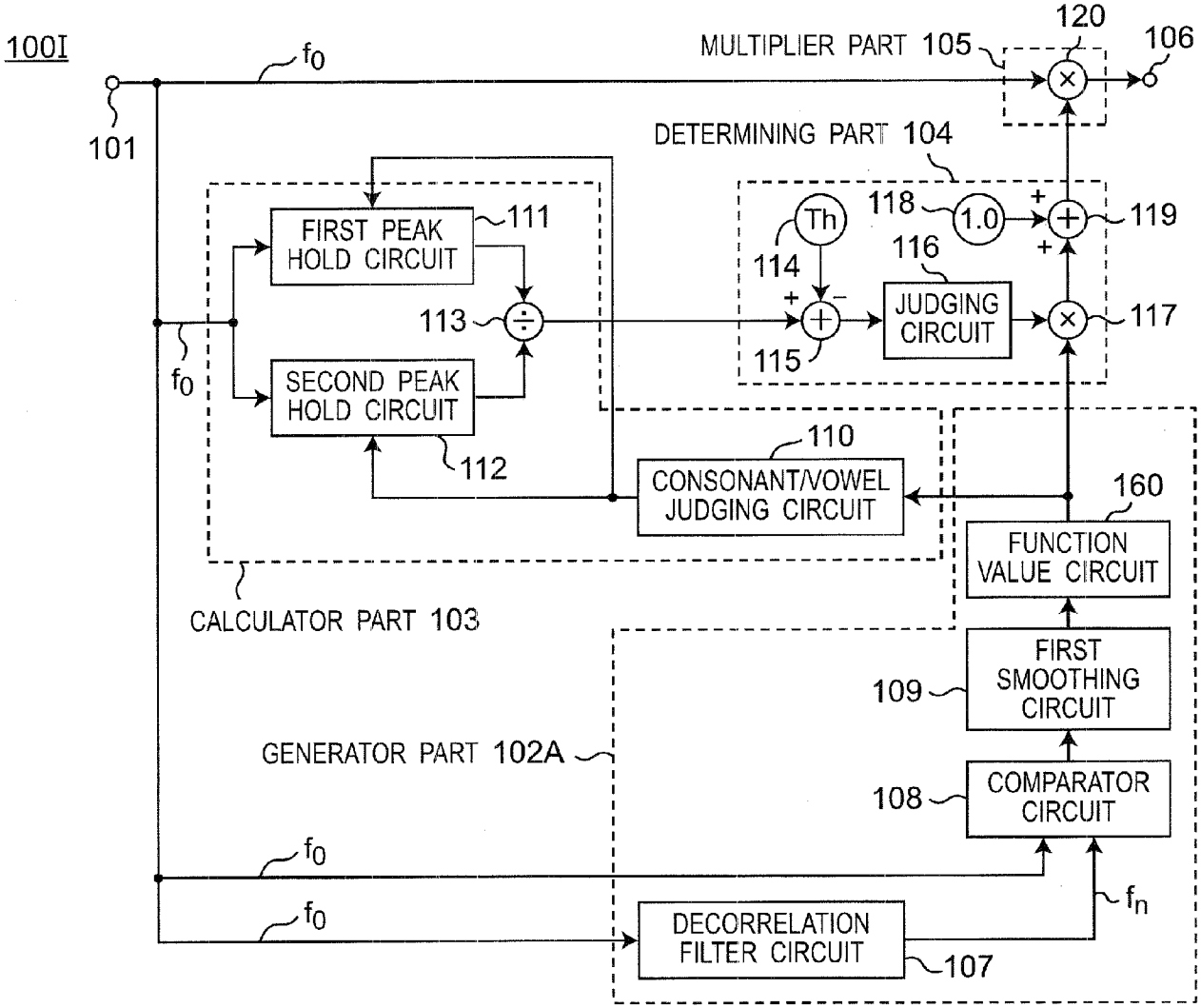
FIG. 8D is a block diagram showing a configuration of a speech enhancement apparatus 100I according to a ninth embodiment of the present disclosure.

FIG. 8D is a block diagram showing a configuration of a speech enhancement apparatus 100I according to the ninth embodiment of the present disclosure. Referring to FIG. 8D, the speech enhancement apparatus 100I is characterized by configuring to include a generator part 102A in place of the generator part 102 by comparison to the speech enhancement apparatus 100 of FIG. 2. Moreover, the generator part 102A is characterized by further including a function value circuit 160 to generate the value representing the likelihood of the consonant based on the value that has undergone the smoothing process from the first smoothing circuit 109 and outputs a resulting signal by comparison to the generator part 102 of FIG. 2.

Referring to FIG. 8D, the function value circuit 160 receives an input of the smoothed value from the first smoothing circuit 109, performs a predetermined calculating process for the smoothed value, and outputs a value of the calculation result as the value representing the likelihood of the consonant to the consonant/vowel judging circuit 110 and the first multiplier circuit 117.

Figure 9A:
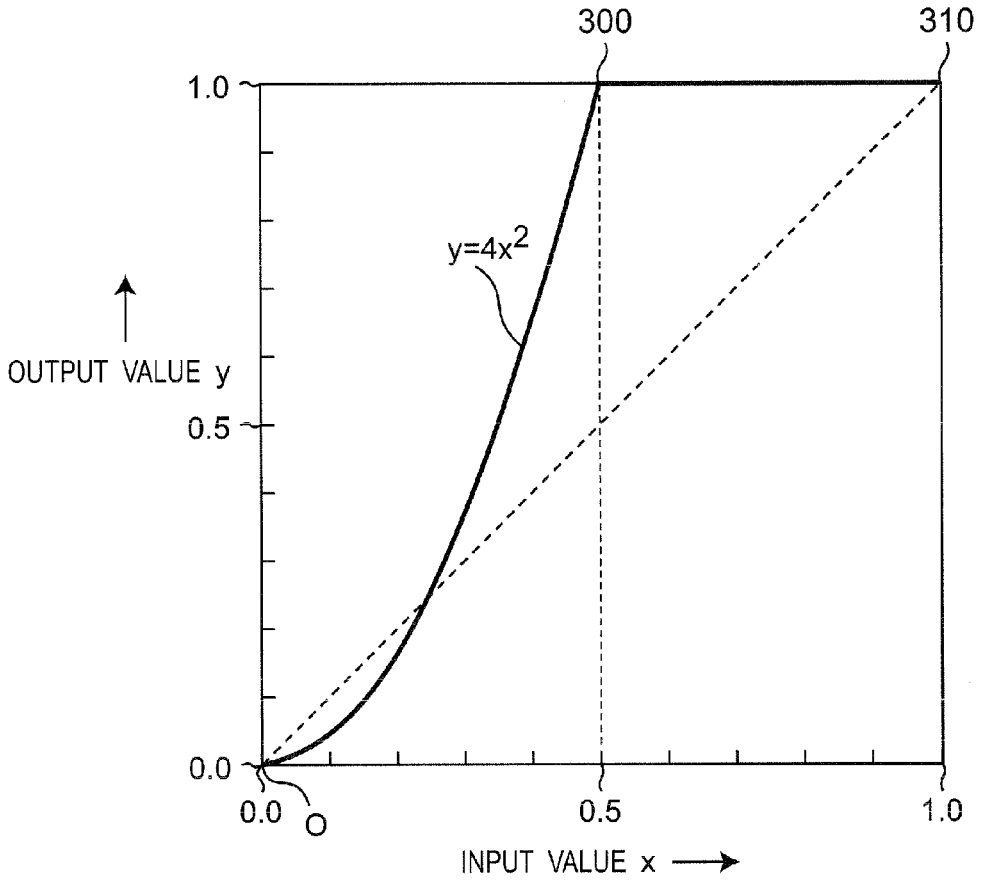
FIG. 9A is a graph showing a change in an output value "y" with respect to an input value "x" of the function value circuit 160 of FIG. 8D.

FIG. 9A is a graph showing a change in the output value "y" with respect to the input value "x" of the function value circuit 160 of FIG. 8D. Referring to FIG. 9A, the function value circuit 160 calculates the output value "y" by the following Equation (4) for the input value "x" from the first smoothing circuit 109. In this case, the output value "y" is the value representing the likelihood of the consonant.

$$\begin{cases} y = 4x^2 & (0 \le x \le 0.5) \\ y = 1 & (0.5 < x \le 1.0) \end{cases}. \tag{4}$$

The speech enhancement apparatus 100I of the present embodiment has action and advantageous effects similar to those of the first embodiment. Moreover, according to the speech enhancement apparatus 100I of the present embodiment, by comparison to the speech enhancement apparatus 100 of the first embodiment, the output value "y" from the function value circuit 160 becomes a value closer to one when the input audio signal $f_0$ is a consonant or the output value "y" from the function value circuit 160 becomes closer to zero when the input audio signal $f_0$ is other than consonants. Therefore, consonants can be further emphasized as compared with other than consonants.

Although the coefficients as indicated in the aforementioned Equation (4) are used in the present embodiment, the present disclosure is not limited to this, and similar advantageous effects can be obtained by using the following Equation (5):

$$\begin{cases} y = ax^2 & (0 \le x \le b) \\ y = 1 & (b < x \le 1.0) \\ ab^2 = 1 \end{cases}, \tag{5}$$

where "a" is a real number equal to or larger than one, "b" is a real number, "x" is the input value to the function value circuit 160, and "y" is the output value from the function value circuit 160. It is noted that the output value "y" is the value representing the likelihood of the consonant.

Moreover, an operational expression other than the aforementioned operational expression may be used.

Figure 9B:
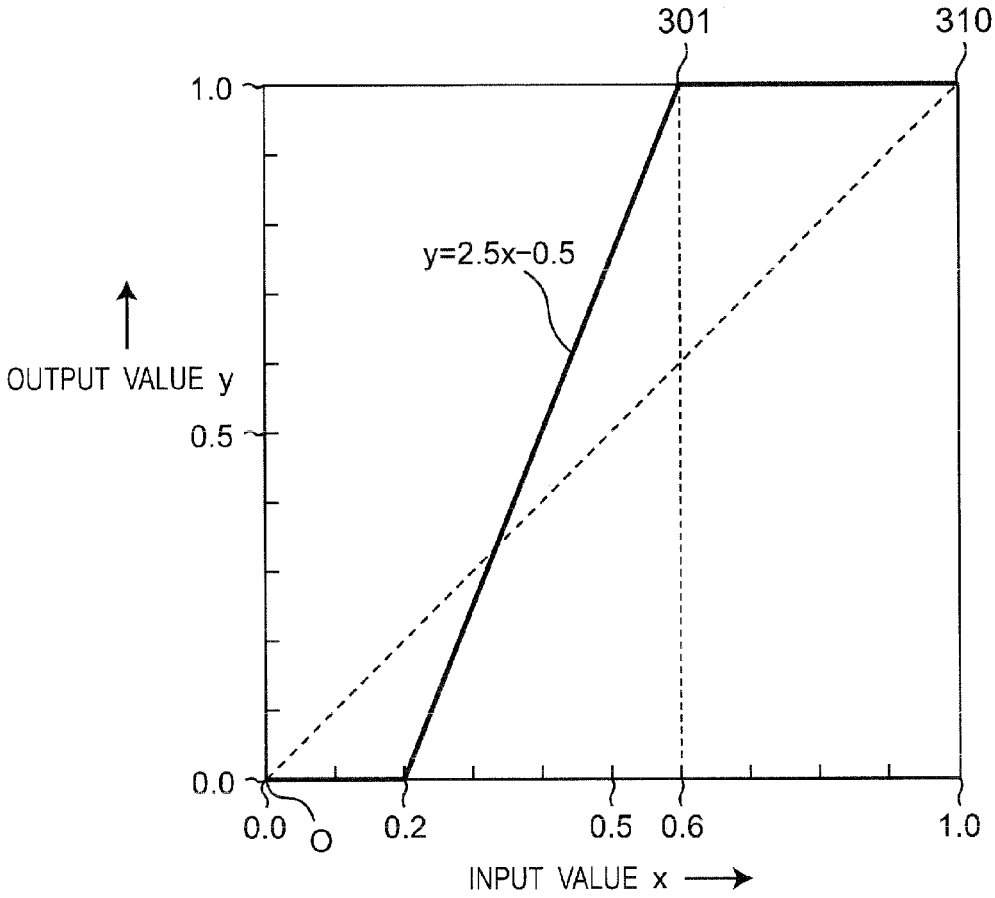
FIG. 9B is a graph showing a change in the output value "y" with respect to the input value "x" of the function value circuit 160 of FIG. 8D according to a modified embodiment of the ninth embodiment of the present disclosure.

FIG. 9B is a graph showing a change in the output value "y" with respect to the input value "x" of the function value circuit 160 of FIG. 8D according to a modified embodiment of the ninth embodiment of the present disclosure. Referring to FIG. 9B, the function value circuit 160 calculates the output value "y" with respect to the input value "x" from the first smoothing circuit 109 by using the following Equation (6). In this case, the output value "y" is the value representing the likelihood of the consonant:

$$\begin{cases} y = 0 & (0 \le x < 0.2) \\ y = 2.5x - 0.5 & (0.2 \le x \le 0.6) \\ y = 1 & (0.6 < x \le 1.0) \end{cases}. \tag{6}$$

The speech enhancement apparatus of the modified embodiment of the ninth embodiment has action and advantageous effects similar to those of the first embodiment. Moreover, according to the speech enhancement apparatus of the present embodiment, by comparison to the speech enhancement apparatus 100 of the first embodiment, the output value "y" from the function value circuit 160 becomes a value closer to one when the input audio signal $f_0$ is a consonant or the output value "y" from the function value circuit 160 becomes a value closer to zero when the input audio signal $f_0$ is other than consonants. Therefore, consonants can be further emphasized by comparison to other than consonants.

Although the coefficients as indicated in the aforementioned Equation (6) are used in the aforementioned modified embodiment of the ninth embodiment, the present disclosure is not limited to this, and similar advantageous effects can be obtained by using the following Equation (7). In the Equation, the constant "c" is smaller than 1.0, and the constant "b" is equal to or larger than 1.0:

$$\begin{cases} y = 0 & (0 \le x < c) \\ y = b \times x - b \times c & (c \le x \le d) \\ y = 1 & (d < x \le 1.0) \\ bd - bc = 1 \end{cases} \quad (7)$$

where "x" is the input value to the function value circuit 160, and "y" is the output value from the function value circuit 160. It is noted that the output value "y" is the value representing the likelihood of the consonant.

Tenth Embodiment

Figure 10:
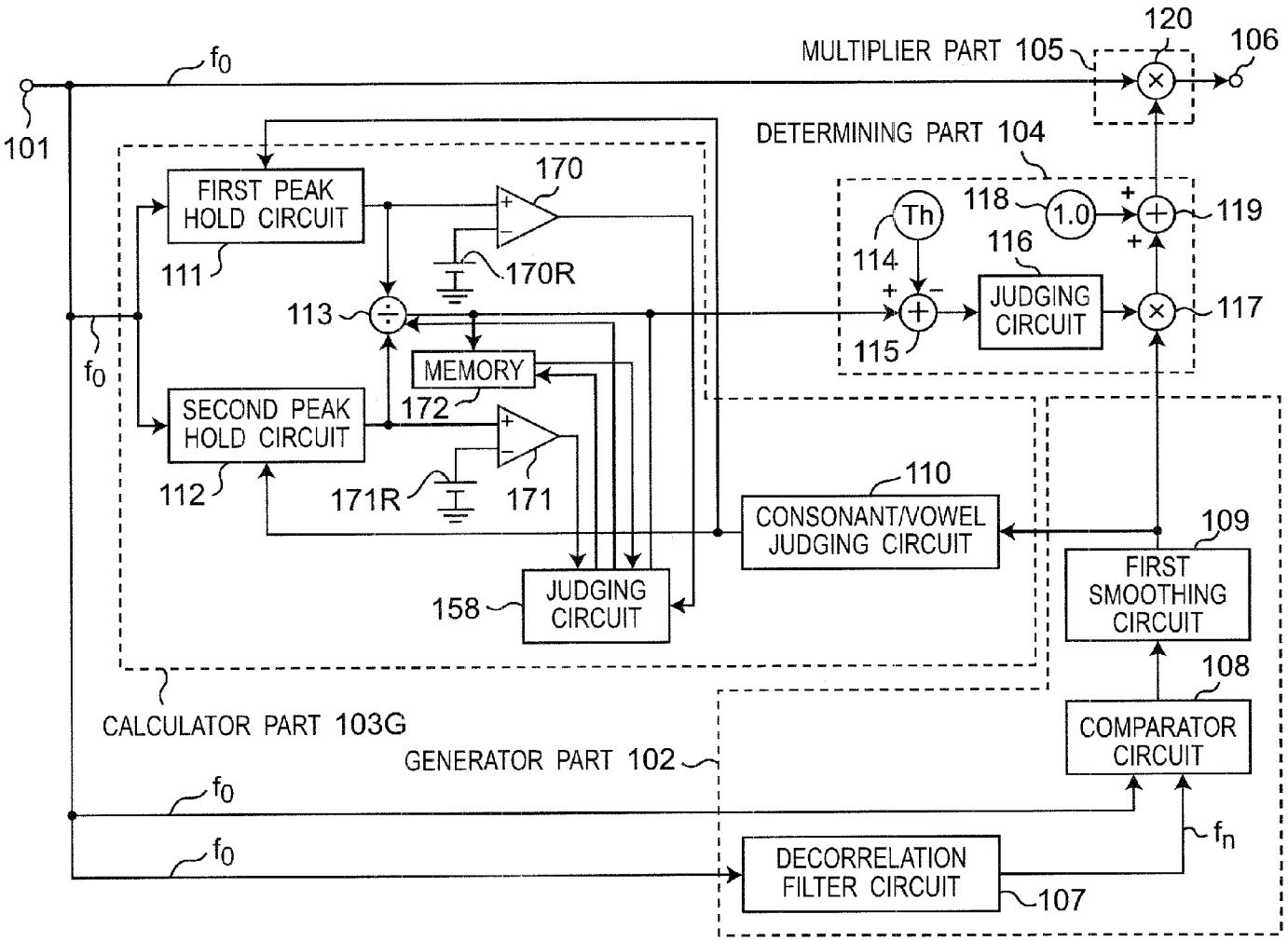
FIG. 10 is a block diagram showing a configuration of a speech enhancement apparatus 100J according to a tenth embodiment of the present disclosure.

FIG. 10 is a block diagram showing a configuration of a speech enhancement apparatus 100J according to the tenth embodiment of the present disclosure. Referring to FIG. 10, the speech enhancement apparatus 100J is characterized by configuring to include a calculator part 103G in place of the calculator part 103 by comparison to the speech enhancement apparatus 100 of FIG. 2. In this case, by comparison to the calculator part 103 of FIG. 2, the calculator part 103G is characterized by further including a comparator 170 having a threshold level 170R at the succeeding stage of the first peak hold circuit 111, a comparator 171 having a threshold level 171R at the succeeding stage of the second peak hold circuit 112, a judging circuit 158 that is a third judging circuit configured to stop the divider circuit 113 based on output results from the comparators 170 and 171, and a memory 172 configured to store the value of the level ratio (V/C) outputted from the divider circuit 113.

Referring to FIG. 10, the comparator 170 compares the voltage level outputted from the first peak hold circuit 111 with the predetermined threshold level 170R, and outputs a comparison result to the judging circuit 158. Moreover, the comparator 171 compares the voltage level outputted from the second peak hold circuit 112 with the predetermined threshold level 171R, and outputs a comparison result to the judging circuit 158.

The judging circuit 158 generates a signal for stopping the divider circuit 113 based on the comparison result from the comparator 170 and the comparison result from the comparator 171, and outputs the same signal to the divider circuit 113 to stop the divider circuit 113. Moreover, the judging circuit 158 reads data of the level ratio (V/C) stored immediately before the stop of the divider circuit 113 from the memory 172 based on the comparison result from the comparator 170 and the comparison result from the comparator 171, and continuously outputs read data to the subtractor circuit 115. In this case, the judging circuit 158 is a third judging circuit, which stops the operation of the divider circuit 113 when the voltage level outputted from the first peak hold circuit 111 is not greater than the predetermined threshold level 170R or when the voltage level outputted from the second peak hold circuit 112 is not greater than the predetermined threshold level 171R, and continuously outputs a value of the level ratio (V/C) immediately before the stop of the divider circuit 113 to the subtractor circuit 115 that is the second subtractor circuit. When the voltage level outputted from the first peak hold circuit 111 is higher than the predetermined threshold level 170R and the voltage level outputted from the second peak hold circuit 112 is higher than the predetermined threshold level 171R, the divider circuit 113 calculates the level ratio (V/C) by dividing the signal level V of other than consonants of the audio signal $f_0$ inputted from the first peak hold circuit 111 by the signal level C of consonants of the audio signal $f_0$ inputted from the second peak hold circuit 112, and outputs a value of the level ratio (V/C) to the subtractor circuit 115.

The speech enhancement apparatus 100J of the present embodiment has action and advantageous effects similar to those of the first embodiment. Moreover, according to the speech enhancement apparatus 100J of the present embodiment, the divider circuit 113 is stopped when either the voltage level outputted from the first peak hold circuit 111 or the voltage level outputted from the second peak hold circuit 112 is not greater than the corresponding predetermined threshold value, and the value of the level ratio (V/C) immediately before the stop of the divider circuit 113 can be continuously outputted to the subtractor circuit 115. Therefore, the value of the level ratio (V/C) can be kept constant in the presumed case of a silence interval, and this therefore makes it possible to promptly appropriately amplify the signal level of consonants in the sound interval after the silent interval.

First Modified Embodiment

Although the filter coefficient $k_{i,j}$ (where "i" is ranging from one to N) of the decorrelation filter circuit 107 is continuously updated every unit time based on the Equation (3) in the aforementioned embodiments, the present disclosure is not limited to this. For example, when the comparator circuit 108 judges that the amplitude of the forward prediction error signal $f_N$ is larger than the amplitude of the audio signal $f_0$, the filter coefficient $k_{i,j}$ may be set to zero. That is, the decorrelation filter circuit 107 includes a forward filter coefficient multiplier circuit and a backward filter coefficient multiplier circuit having respective filter coefficients, and sets the filter coefficient to zero when the filter output signal is larger than the amplitude of the audio signal. In this case, the fact that the amplitude of the prediction error signal $f_N$ is larger than the amplitude of the audio signal $f_0$ means that the audio signal $f_0$ is not predicted by the decorrelation filter circuit 107. Therefore, in this case, it is highly possible that the audio signal $f_0$ passing through the decorrelation filter circuit 107 is a consonant. Accordingly, by setting the filter coefficient $k_{i,j}$ to zero, the filter coefficient $k_{i,j}$ as a consequence of the continuous output of the noncorrelated signal to the lattice filter circuit can be prevented from diverging, and the decorrelation filter circuit 107 can be stably allowed to operate.

The speech enhancement apparatus of the aforementioned modified first embodiment can obtain action and advantageous effects similar to those of the first embodiment. Moreover, according to the speech enhancement apparatus of the first modified embodiment, the decorrelation filter circuit 107 can be allowed to operate more stably by comparison to the speech enhancement apparatus 100 of the first embodiment.

Second Modified Embodiment

Although the judging circuit 116 outputs a value of zero when the output of the subtractor circuit 115 is a negative value or outputs a value of the level ratio (V/C) as it is in the other case in the aforementioned embodiments, the present disclosure is not limited to this. By outputting the value of zero when the output value of the subtractor circuit 115 is a negative value or outputting a constant value in the other case, the value for multiplication on the audio signal $f_0$ inputted in the second multiplier circuit 120 when the input audio signal $f_0$ is a consonant also becomes a constant. Therefore, it is possible that the amplification gain of consonants is fixed for easy hearing by comparison to the speech enhancement apparatus of the aforementioned embodiments.

Third Modified Embodiment

Although the lattice filter circuit is used as the decorrelation filter circuit 107 in the speech enhancement apparatuses of the aforementioned embodiments, the present disclosure is not limited to this, and, for example, a FIR filter circuit, an IIR filter circuit or the like may be used. In this case, the amount of calculation can be further reduced by comparison to the aforementioned embodiments.

Fourth Modified Embodiment

Although the level ratio (V/C) is obtained by the divider circuit 113 in the speech enhancement apparatuses of the aforementioned embodiments, the present disclosure is not limited to this, and, for example, an upper limit value may be set on the level ratio (V/C). According to this configuration, excessive amplification of consonants can be prevented by comparison to the aforementioned embodiments.

It is noted that the aforementioned constant value generators 118 and 156 may be a shift register that includes, for example, a recording region or a computer-executable program that generates a constant value and a computer-readable recording medium that records the program.

INDUSTRIAL APPLICABILITY

As described in detail above, according to the speech enhancement apparatus and the speech enhancement method of the present disclosure, the articulation of the audio signal can be improved, and therefore, they can be applied to applications necessary for supporting the listener's hearing like a hearing aid and language learning equipment.

Although the present disclosure has been fully described in connection with the embodiments thereof with reference to the accompanying drawings, it is to be noted that various changes and modifications are apparent to those skilled in the art. Such changes and modifications are to be understood as included within the scope of the present disclosure as defined by the appended claims unless they depart therefrom.

What is claimed is:

1. A speech enhancement apparatus comprising:

a generator part configured to generate and output a value representing likelihood of a consonant from an input audio signal having a predetermined sampling frequency;

a calculator part configured to generate a consonant/vowel discriminating signal for discriminating a consonant portion and a vowel portion in the audio signal based on the value representing the likelihood of the consonant, detect a first signal level of the vowel portion and a second signal level of the consonant portion in the audio signal based on the audio signal and the consonant/vowel discriminating signal, and output a level-related signal representing a relation of the first signal level with respect to the second signal level;

a determining part configured to determine a gain coefficient that exceeds one when the second signal level is smaller than the first signal level based on the level-related signal so that the gain coefficient increases as the second signal level becomes smaller than the first signal level; and a multiplier part configured to multiply the audio signal by the gain coefficient and output an audio signal having an emphasized consonant portion thereof.

2. The speech enhancement apparatus as claimed in claim 1, wherein the gain coefficient is a value closing to one when the second signal level is larger than the first signal level.

3. The speech enhancement apparatus as claimed in claim 1, wherein the generator part comprises:

a decorrelation filter circuit configured to remove a signal component having an autocorrelation from the audio signal, and output a signal having no periodicity as a filter output signal;

a comparator circuit configured to compare an amplitude of the signal having no periodicity with an amplitude of the audio signal, and output a comparison result; and a first smoothing circuit configured to generate and output a value representing the likelihood of the consonant by subjecting the comparison result to a smoothing process.

4. The speech enhancement apparatus as claimed in claim 1, wherein the generator part comprises:

a decorrelation filter circuit configured to remove a signal component having an autocorrelation from the audio signal, and output a signal having no periodicity as a filter output signal;

a comparator circuit configured to compare an amplitude of the signal having no periodicity with an amplitude of the audio signal, and output a comparison result;

a first smoothing circuit configured to subject the comparison result to a smoothing process, and output a value that has undergone the smoothing process; and a function value circuit configured to generate and output a value representing likelihood of the consonant based on the value that has undergone the smoothing process, wherein the function value circuit calculates the value representing the likelihood of the consonant by the following equations:

$$\begin{cases} y = ax^2 & (0 \le x \le b) \\ y = 1 & (b < x \le 1.0) \\ ab^2 = 1 \end{cases},$$

where "a" is a real number equal to or larger than one, "b" is a real number, "x" is an input value to the function value circuit, and "y" is a value representing the likelihood of the consonant.

5. The speech enhancement apparatus as claimed in claim 3, wherein the decorrelation filter circuit is a sequential adaptive filter circuit.

6. The speech enhancement apparatus as claimed in claim 3, wherein the decorrelation filter circuit includes a forward filter coefficient multiplier circuit and a backward filter coefficient multiplier circuit, which have respective filter coefficients, respectively, and wherein the filter coefficient is set to zero when the filter output signal has an amplitude larger than the amplitude of the audio signal.

7. The speech enhancement apparatus as claimed in claim 1, wherein the calculator part further comprises a second smoothing circuit configured to subject the level-related signal to a smoothing process, and output a resulting signal to the determining part.

8. The speech enhancement apparatus as claimed in claim 1, wherein the calculator part comprises:

a consonant/vowel judging circuit configured to generate and output a consonant/vowel discriminating signal indicating whether the audio signal is a consonant or other than consonants based on the value representing the likelihood of the consonant;

a first integrator circuit configured to detect the first signal level based on the consonant/vowel discriminating signal;

a second integrator circuit configured to detect the second signal level based on the consonant/vowel discriminating signal; and a divider circuit configured to calculate a level ratio by dividing the first signal level by the second signal level, and output the level ratio as the level-related signal.

9. The speech enhancement apparatus as claimed in claim 8, wherein the determining part comprises:

a first subtractor circuit configured to subtract a predetermined threshold value from the level ratio outputted from the divider circuit, and output a value of subtraction result;

a first judging circuit configured to output a value of zero when the value of the subtraction result outputted from the first subtractor circuit is a negative value, and to output a value of subtraction result as it is when the subtraction result of the first subtractor circuit is other than a negative value;

a multiplier circuit configured to multiply the value representing the likelihood of the consonant by a value inputted from the first judging circuit, and output a value of multiplication result; and an adder circuit configured to add a constant of "1.0" to the value of the multiplication result inputted from the multiplier circuit, and output a value of addition result as the gain coefficient to the multiplier part.

10. The speech enhancement apparatus as claimed in claim 8, wherein the determining part comprises:

a first subtractor circuit configured to subtract a predetermined threshold value from the level ratio outputted from the divider circuit, and output a value of subtraction result;

a first judging circuit configured to output a value of zero when the value of the subtraction result outputted from the first subtractor circuit is a negative value, and to output a predetermined constant when the subtraction result of the first subtractor circuit is other than a negative value;

a multiplier circuit configured to multiply the value representing the likelihood of the consonant by the value inputted from the first judging circuit, and output a value of multiplication result; and an adder circuit configured to add a constant of one to the value of the multiplication result inputted from the multiplier circuit, and output a value of addition result as the gain coefficient to the multiplier part.

11. The speech enhancement apparatus as claimed in claim 9, wherein the determining part further comprises:

a second subtractor circuit configured to subtract the value of the multiplication result outputted from the multiplier circuit from the value of the constant of one, and output a value of subtraction result as the gain coefficient to the multiplier part; and a first switchover part configured to perform selective switchover as to whether the value of the multiplication result outputted from the multiplier circuit is outputted to the multiplier part via the adder circuit, or outputted to the multiplier part via the second subtractor circuit.

12. The speech enhancement apparatus as claimed in claim 9, wherein the calculator part further comprises:

a third integrator circuit configured to measure a minimum signal level of the audio signal; and a second switchover part configured to perform selective switchover as to whether the value of a constant of zero to the first subtractor circuit when the minimum signal level is equal to or larger than a predetermined second threshold value, or the value of the level ratio outputted from the divider circuit is outputted to the first subtractor circuit when the minimum signal level is smaller than a predetermined second threshold value.

13. The speech enhancement apparatus as claimed in claim 8, wherein the first integrator circuit is a first peak hold circuit; and wherein the second integrator circuit is a second peak hold circuit.

14. The speech enhancement apparatus as claimed in claim 8, wherein the calculator part further comprises:

a first judging part configured to judge that the input audio signal is silence when the signal level of the input audio signal is not greater than a predetermined threshold value, and stop the first integrator circuit.

15. The speech enhancement apparatus as claimed in claim 8, wherein the calculator part further comprises:

a second judging part configured to judge that the input audio signal is silence when a difference between the signal level of the audio signal and the signal level of the filter output signal is smaller than a predetermined value, and stop the first integrator circuit.

16. The speech enhancement apparatus as claimed in claim 8, wherein the calculator part further comprises:

a second judging circuit configured to allow the divider circuit to operate only for a definite period after a change from a consonant to a vowel, or after a change from a vowel to a consonant based on the consonant/vowel discriminating signal.

17. The speech enhancement apparatus as claimed in claim 8, wherein the calculator part further comprises:

a memory configured to store the value of the level ratio outputted from the divider circuit; and a third judging circuit configured to judge that the input audio signal is silence when either one of the voltage levels outputted from the first integrator circuit and the second integrator circuit is not greater than the corresponding predetermined threshold value to stop the divider circuit, read the value of the level ratio stored immediately before the stop of the divider circuit from the memory, and continuously output a read value to the second subtractor circuit.

18. The speech enhancement apparatus as claimed in claim 8, wherein the calculator part further comprises:

a timer circuit configured to measure a predetermined first time, allow the first integrator circuit and the second integrator circuit to measure maximum values of the first signal level and the second signal level within the predetermined first time, and allow the divider circuit to operate after a lapse of every predetermined first time.

19. A speech enhancement method for a speech enhancement apparatus configured to emphasize a consonant portion in an input audio signal, the speech enhancement method comprising:

generating a value representing likelihood of a consonant from the audio signal inputted at a predetermined sampling frequency and outputting the value;

generating a consonant/vowel discriminating signal for discriminating a consonant portion and a vowel portion in the audio signal based on the value representing likelihood of a consonant, detecting a first signal level of the vowel portion and a second signal level of the consonant portion in the audio signal based on the audio signal and the consonant/vowel discriminating signal, and outputting a level-related signal representing a relation of the first signal level with respect to the second signal level;

determining a gain coefficient that exceeds one when the second signal level is smaller than the first signal level based on the level-related signal so that the gain coefficient increases as the second signal level becomes smaller than the first signal level; and multiplying the audio signal by the gain coefficient, and outputting an audio signal having an emphasized consonant portion thereof.

* * * * *